US008000614B2

(12) United States Patent
Okino et al.

(10) Patent No.: US 8,000,614 B2
(45) Date of Patent: Aug. 16, 2011

(54) DEVELOPER SUPPLY CONTAINER AND DEVELOPER SUPPLY SYSTEM

(75) Inventors: Ayatomo Okino, Moriya (JP); Katsuya Murakami, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 11/718,280

(22) PCT Filed: Feb. 23, 2006

(86) PCT No.: PCT/JP2006/303928

§ 371 (c)(1),
(2), (4) Date: Jan. 14, 2009

(87) PCT Pub. No.: WO2006/090901

PCT Pub. Date: Aug. 31, 2006

(65) Prior Publication Data

US 2009/0129825 A1 May 21, 2009

(30) Foreign Application Priority Data

Feb. 24, 2005 (JP) ..... 2005-048408

(51) Int. Cl.
*G03G 15/00* (2006.01)

(52) U.S. Cl. ..... 399/12; 399/111; 399/262

(58) Field of Classification Search ..... 399/25, 399/36, 11, 12, 262
See application file for complete search history.

(56) References Cited

U.S. PATENT DOCUMENTS 4,740,808 A * 4/1988 Kasamura et al. ..... 399/12
5,819,144 A 10/1998 Okada et al. ..... 399/258
6,049,685 A 4/2000 Murakami et al. ..... 399/263
6,128,453 A 10/2000 Ban et al. ..... 399/106
6,278,853 B1 8/2001 Ban et al. ..... 399/109
6,292,644 B1 * 9/2001 Goto et al. ..... 399/262
RE38,737 E 5/2005 Ban et al. ..... 399/106
6,947,690 B2 9/2005 Tazawa et al. ..... 399/258
7,050,728 B2 5/2006 Minagawa et al. ..... 399/27

(Continued)

FOREIGN PATENT DOCUMENTS

CN 1492290 4/2004

(Continued)

OTHER PUBLICATIONS

Chinese Office Action issued Oct. 17, 2008, in Appln. No. 200680002527.1 and English-language translation thereof.

(Continued)

*Primary Examiner* — David M Gray
*Assistant Examiner* — Roy Yi
(74) *Attorney, Agent, or Firm* — Fitzpatrick, Cella, Harper & Scinto

(57) ABSTRACT

A developer supply container detachably mounts to a developer receiving apparatus and supplies a developer by rotation and includes a regulation portion for determining whether or not the developer supply container should be mounted by being regulated by a regulation member of the developer receiving apparatus and a lead portion which is movable relative to a guiding portion of the developer receiving apparatus so that the regulation member and the regulation portion are in phase with each other. When the developer supply container is inserted in a direction of a rotation axis thereof, a phase of the regulation portion with the regulation member is determined by movement of the lead portion of the developer supply container relative to the guiding portion of the developer receiving apparatus and then is regulated by the regulation member.

30 Claims, 15 Drawing Sheets

U.S. PATENT DOCUMENTS

| | | | | |
|---|---|---|---|---|
| 7,242,893 | B2 | 7/2007 | Murakami et al. | 399/262 |

FOREIGN PATENT DOCUMENTS

| | | |
|---|---|---|
| EP | 1 411 395 | 4/2004 |
| JP | 58-113960 | 7/1983 |
| JP | 59-126566 | 7/1984 |
| JP | 62-198884 | 9/1987 |
| JP | 7-168430 | 7/1995 |
| JP | 10-63077 | 3/1998 |
| JP | 2004-138694 | 5/2004 |

OTHER PUBLICATIONS

Japanese Office Action dated May 11, 2010, in Japanese Application No. 2005-048408, and partial-English-language translation thereof.

* cited by examiner

DEVELOPER SUPPLY CONTAINER AND DEVELOPER SUPPLY SYSTEM

TECHNICAL FIELD

The present invention relates to a developer supply container for supplying developer to an image forming apparatus using electrophotography or electrostatic recording such as a copying machine, a printer, a facsimile apparatus, etc., and a developer supply system using the developer supply container.

BACKGROUND ART

In an image forming apparatus such as an electrophotographic copying machine or a printer, as a developing agent, a fine powdery developer has been conventionally used. Further, in the case where the developer in a main assembly of the image forming apparatus is consumed, the developer is supplied to the image forming apparatus by using a developer supply container.

As a method of supplying the developer, since the developer is very fine powder as described above, such a method that a developer supply container is mounted in the main assembly of the image forming apparatus so that the developer is not scattered, during a developer supply operation and is discharged from an opening little by little has been adopted. The developer supply container which is used in accordance with such a developer supply method has a bottle-like shape which is substantially cylindrical and is mounted and used in the image forming apparatus main assembly. The developer supply container itself is rotated by receiving a driving force from the image forming apparatus main assembly to feed and discharge the developer. Such a developer supply container has been proposed.

The above-described image forming apparatus main assembly and the developer supply container have been used in common with various kinds of image forming apparatuses in order to reduce costs. However, when the commonality thereof is completely realized, there arises such a problem that a developer supply container containing a developer different in color or kind from a proper developer supply container to be mounted is erroneously mounted in the main assembly of image forming apparatus (hereinafter referred to as a "setting (mounting) error").

For this reason, in recent years, in order to prevent such a setting error that the developer supply container containing a different developer is erroneously mounted in the image forming apparatus main assembly, for example, such a measure that detection of a setting error of the developer supply container containing a different kind of developer is performed by a combination of a recess portion provided to the image forming apparatus and a projection portion provided to the developer supply container (Japanese Laid-Open Patent Applications Nos. Hei 10-63077, Hei 7-168430, 2004-138694, etc.).

However, in the case of employing the combination, an operation for aligning a position of the projection portion of the developer supply container with a position of the recess portion of the image forming apparatus main assembly is required to be performed by an operator. Accordingly, in the conventional constitution, a positional alignment operation becomes required, thus putting a burden on the operator.

DISCLOSURE OF THE INVENTION

An object of the present invention is to provide a developer supply container capable of being easily set or mounted in a developer receiving apparatus even in the case where a constitution for determining adaptability of the developer supply container to the developer receiving apparatus is employed.

Another object of the present invention is to provide a developer supply system capable of easily setting or mounting a developer supply container in a developer receiving apparatus even in the case where there is provided a structure for determining the adaptability of the developer supply container to the developer receiving apparatus.

According to an aspect of the present invention, there is provided a developer supply container, detachably mountable to a developer receiving apparatus, for supplying a developer to the developer receiving apparatus, comprising:

an adaptation portion for determining the adaptability of the developer supply container to the developer receiving apparatus depending on a relationship with an adaptation member provided in the developer receiving apparatus; and a lead portion for leading the adaptation portion to the adaptation member by an operation for mounting the developer supply container in the developer receiving apparatus.

According to another aspect of the present invention, there is provided a developer supply container, detachably mountable to a developer receiving apparatus, for supplying a developer to the developer receiving apparatus, comprising:

an adaptation portion for determining the adaptability of the developer supply container to the developer receiving apparatus depending on a relationship with an adaptation member provided rotatably in the developer receiving apparatus; and a lead portion for leading the adaptation member to the adaptation portion by an operation for mounting the developer supply container in the developer receiving apparatus.

According to a further aspect of the present invention, there is provided a developer supply system, comprising:

a developer supply container, detachably mountable to the developer receiving apparatus, for supplying a developer to the developer receiving apparatus;

an adaptation member provided in the developer receiving apparatus;

an adaptation portion, provided in the developer supply container for determining the adaptability of the developer supply container to the developer receiving apparatus depending on a relationship with the adaptation member provided in the developer receiving apparatus; and rotational moving means for rotationally moving at least one of the adaptation portion and the adaptation member so that the adaptation portion and the adaptation member are opposite to each other by an operation for mounting the developer supply container in the developer receiving apparatus.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

Hereinbelow, preferred embodiments of the present invention will be described specifically with reference to the drawings.

In the following embodiments, the dimensions, the materials, the shapes, and the relative arrangements of constitutional parts or members are illustrative and may appropriately modified depending on constitutions or various conditions of apparatuses to which the present invention is applicable. Accordingly, it should not be understood that the scope of the present invention is limited to only those in the following description unless otherwise specified.

First Embodiment

First embodiment of the present invention will be described in detail with reference to the drawings.

Figure 1:
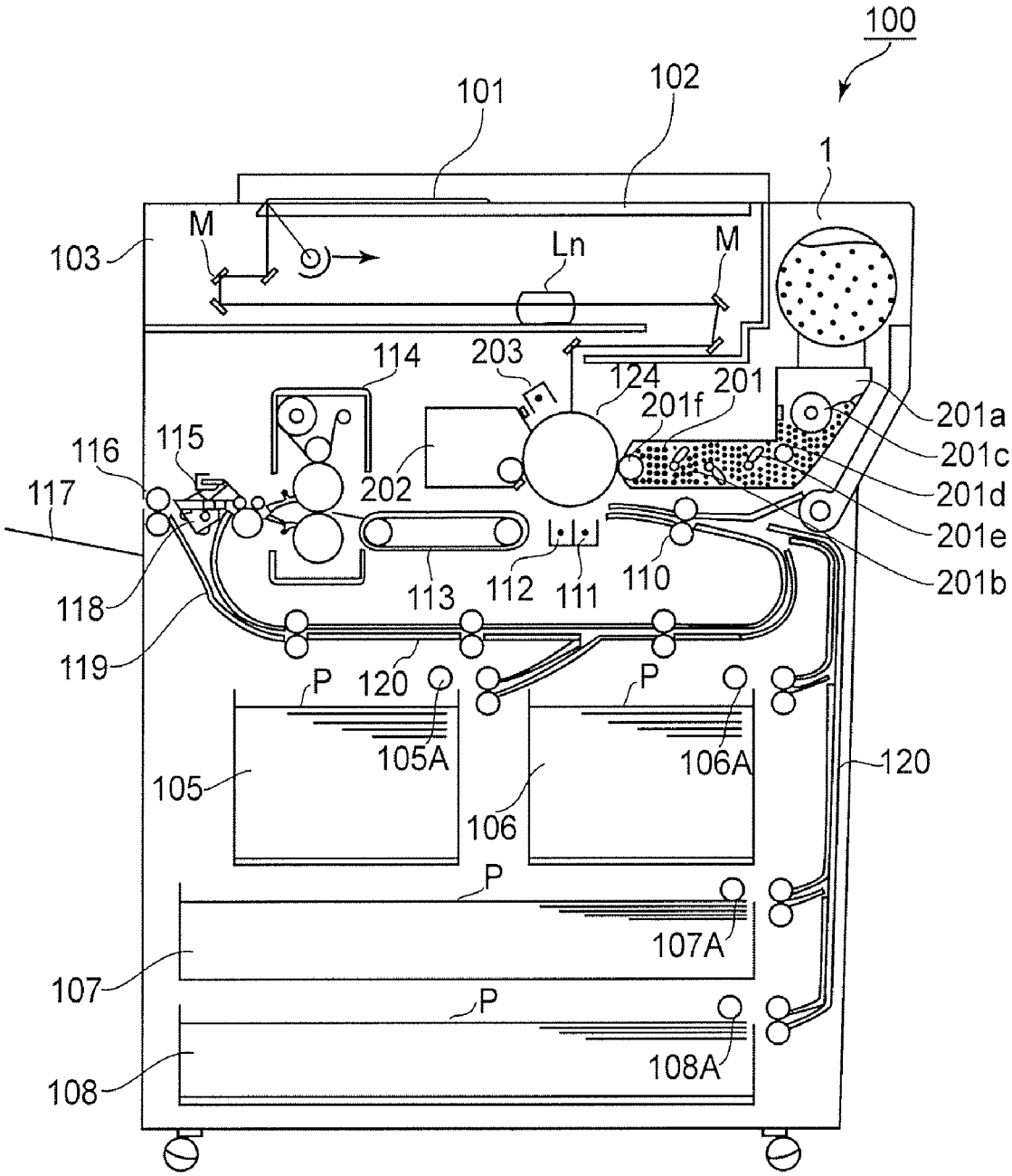
FIG. 1 is a sectional view showing an embodiment of an image forming apparatus associated with the present invention.
Figure 2:
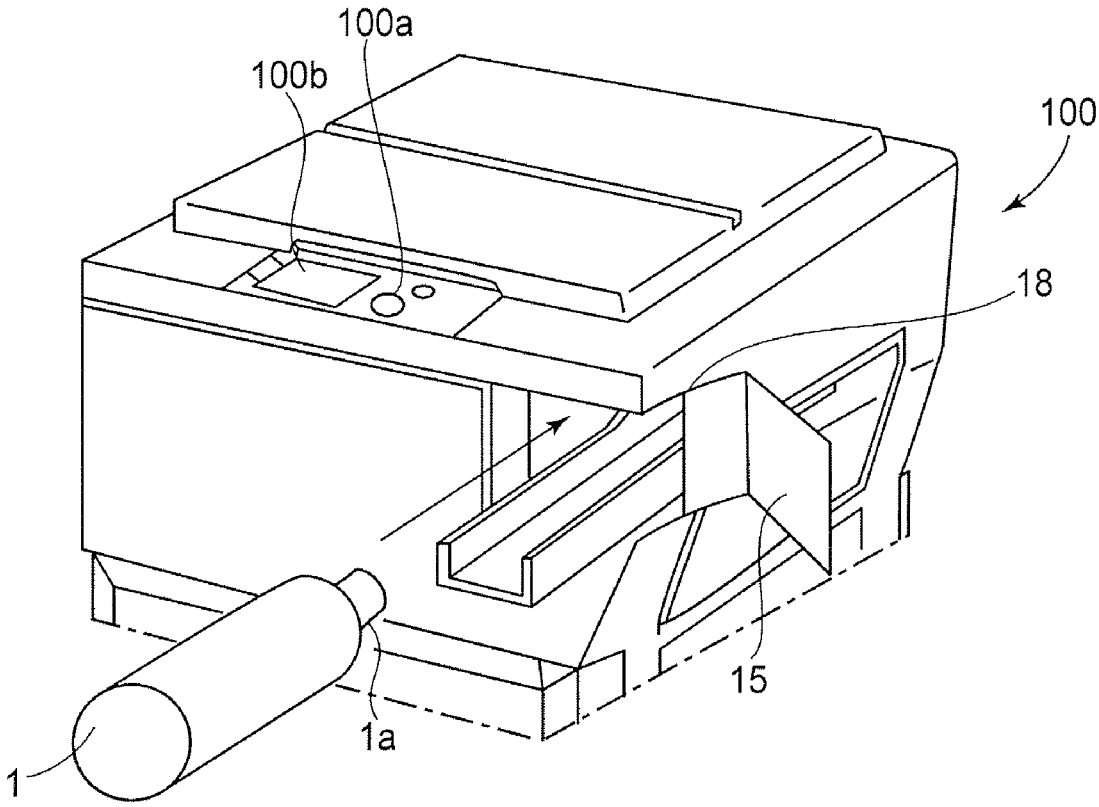
FIG. 2 is a perspective view showing an operation for inserting a developer supply container into an image forming apparatus main assembly.

FIG. 1 is a schematic sectional view showing an embodiment of an image forming apparatus to which the present invention is applicable. FIG. 2 is a perspective view showing an operation for inserting the developer supply container according to the present invention into the image forming apparatus.

(Image Forming Apparatus)

First of all, with reference to FIGS. 1 and 2, a general constitution and a general operation of the image forming apparatus as a developer receiving apparatus to which the developer supply container of the present invention is detachably mountable (settable) will be described.

In FIGS. 1 and 2, a reference numeral 100 represents a main assembly of an electrophotographic copying machine (hereinafter referred to as a "apparatus main assembly"). On the apparatus main assembly 100, an original 101 is placed on an original supporting glass 102. A light image depending on image information is formed on an electrophotographic photosensitive drum 124 as an image-bearing member (hereinafter referred to as a "photosensitive drum") by a plurality of mirrors M and lens Ln. Recording media P such as paper or the like is stacked in cassettes 105, 106, 107 and 108, and an optimum recording medium is selected from information on the size of recording media in the cassette 105-108 on the basis of information inputted in an operation portion by an operator (user) or a size of the original 101. Here, as the recording medium, it is not limited to paper but may appropriately selected from those including an OHP sheet, etc.

One recording medium P fed by a feeding/separating apparatuses 105A, 106A, 107A and 108A is fed to a registration roller 110 through a feeding portion. Further, the recording medium P is fed to a transfer portion by the registration roller 110 while synchronizing timing of rotation of the photosensitive drum 124 with timing of scanning of an optical portion 103. At the transfer portion, a developer image formed on the photosensitive drum 124 is transferred onto the recording medium P by a transfer charger 111. Then, by a separation discharger 112, the recording medium P onto which the developer image is transferred is separated from the photosensitive drum 124.

Thereafter, the recording medium P conveyed to a fixing portion 114 by a conveying portion 113 is subjected to fixation of the developer image thereon under heat and pressure, and is caused to pass through a discharge inversion portion 115 to be discharged (outputted) on a discharge tray 117 by a discharge roller 116 in the case of one-sided copying. In the case of two-sided copying, by controlling a flapper 118 of the discharge inversion portion 115, the recording medium P is discharged on the discharge tray 117 through the same path as in the case of the one-sided copying after being conveyed to the registration roller 110 through re-feeding paths 119 and 120.

Further, in the case of multiple copying, the recording medium P is caused to pass through the discharge inversion portion 115 to be once partially discharged outside the apparatus main assembly 100 by the discharge roller 116. Thereafter, a trailing end of the recording medium P is caused to pass through the flapper 118 and conveyed into the apparatus main assembly 100 by controlling the flapper 118 and reversely rotating the discharge roller 116 at a timing at which the recording medium P is still sandwiched between the discharge rollers 116. As a result, the recording medium is conveyed again into the apparatus main assembly 100. Thereafter, the recording medium P is conveyed to the registration roller 110 via the re-feeding paths 119 and 120 and then is discharged on the discharge tray 117 through the same paths as in the case of the one-sided copying.

Incidentally, around the photosensitive drum 124 in the apparatus main assembly 100, a developing apparatus 201, a cleaning apparatus (cleaner) 202, a primary charger 203, and so on are disposed.

Here, the developing apparatus 201 develops an electrostatic latent image, with developer, formed on the photosensitive drum 124 by the optical portion 103 on the basis of the image information of the original 101. Further, a developer supply container 1 for supplying developer to the developing apparatus 201 is disposed detachably mountable to the apparatus main assembly 100 by the user. The present invention is applicable even in the cases where only toner as the developer is supplied from the developer supply container to the image forming apparatus or toner and a carrier as the developer is supplied. In this embodiment, only the toner is supplied from the developer supply container.

The developing apparatus 201 has a developer hopper 201*a* and a developing device 201*b*. The developer hopper 201*a* has a stirring member 201*c* for stirring the developer supplied from the developer supply container 1. The developer stirred by the stirring member 201*c* is fed to the developing device 201*b* by a magnet roller 201*d*. The developing device 201*b* includes a developing roller 201*f* and a feeding member 201*e*. The developer fed from the developer hopper 201*a* by the magnet roller 201*d* is sent to the developing roller 201*f* by the feeding member 201*e*, thus being supplied to the photosensitive drum 124 by the developing roller 201*f*.

The cleaning apparatus 202 is used for removing developing remaining on the photosensitive drum 124. Further, the primary charger 203 is used for electrically charging the photosensitive drum 104.

[Developer Supply Container]

The developer supply container will be described with reference to FIGS. 3-7.

Figure 3:
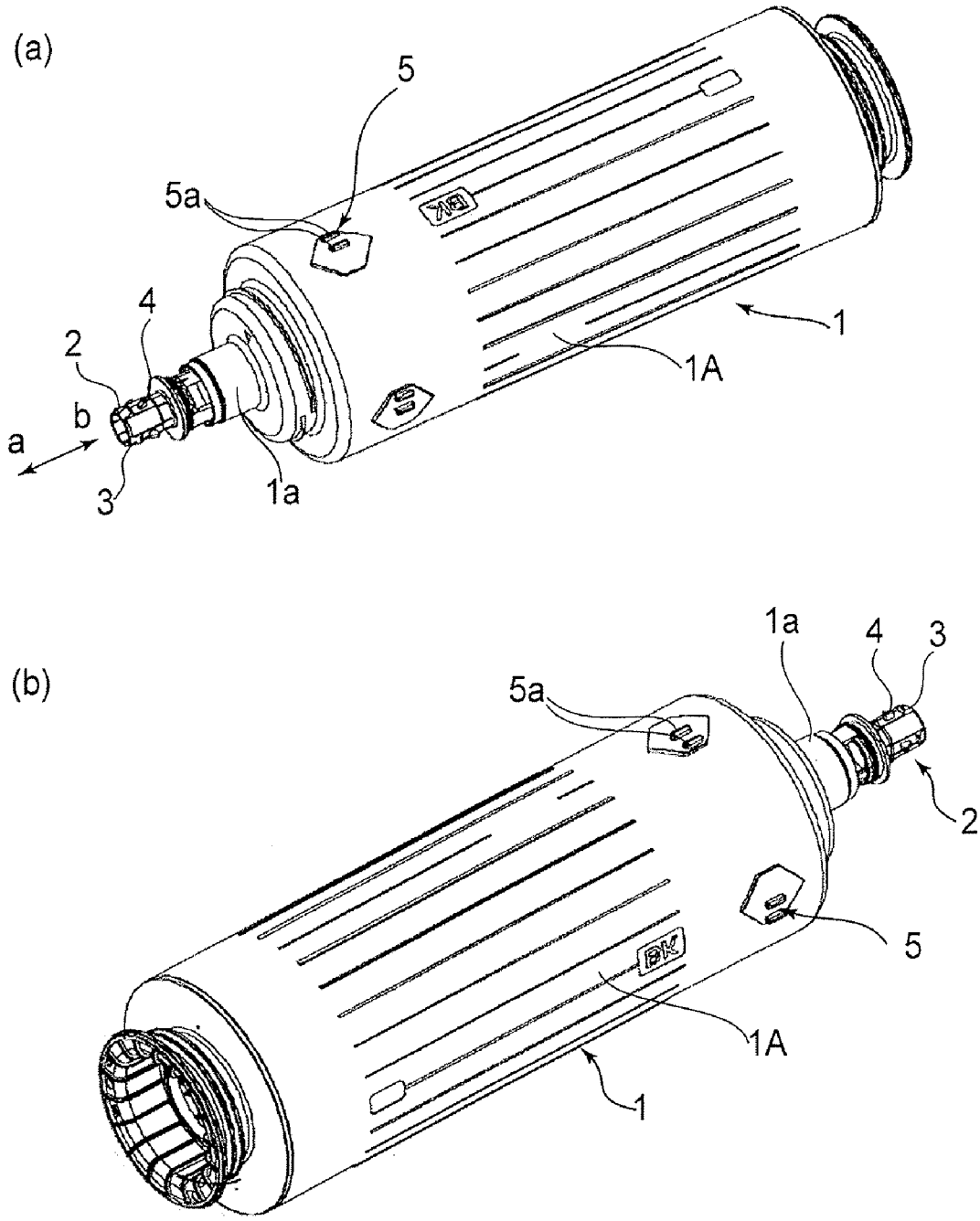
FIGS. 3(*a*) and 3(*b*) are perspective views each showing a developer supply container.
Figure 4:
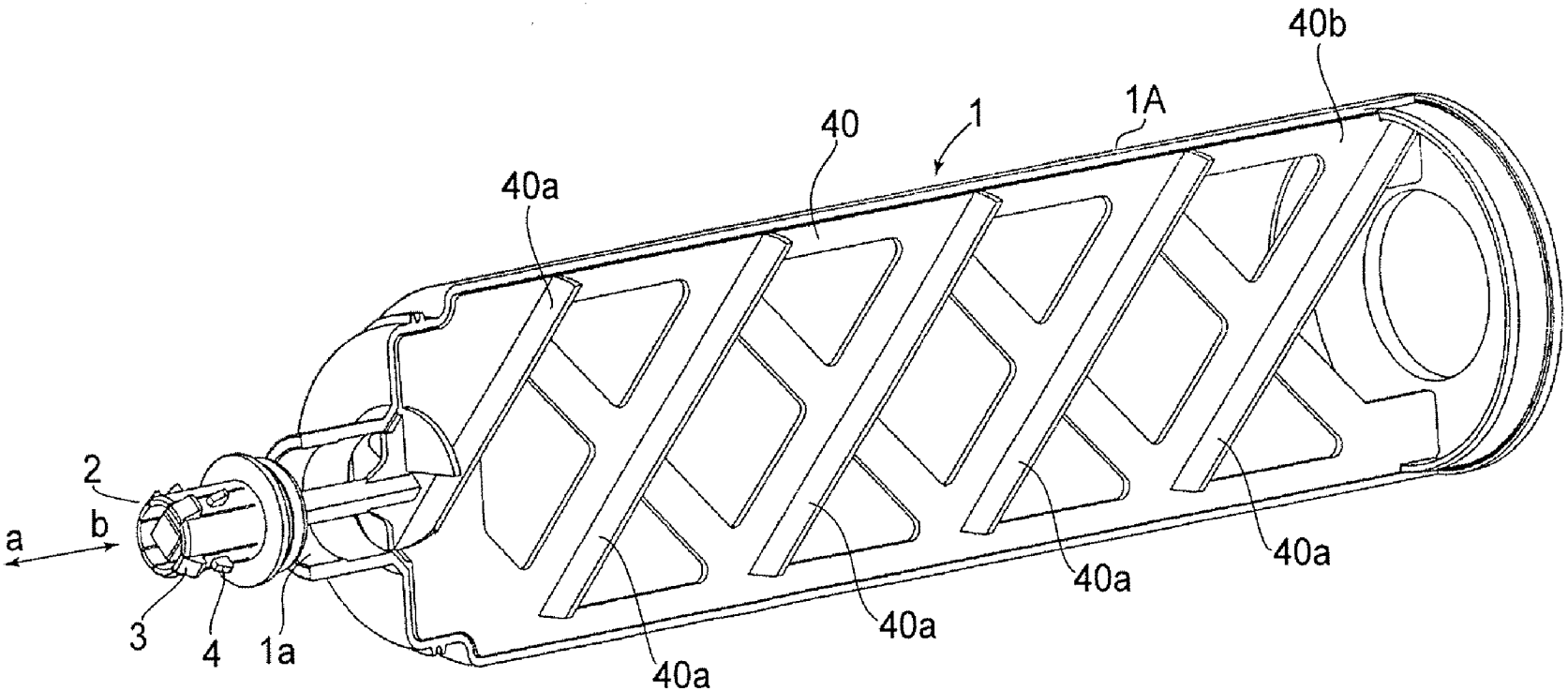
FIG. 4 is a sectional perspective view in the case where a feeding member in a developer supply container is a baffle member.
Figure 5:
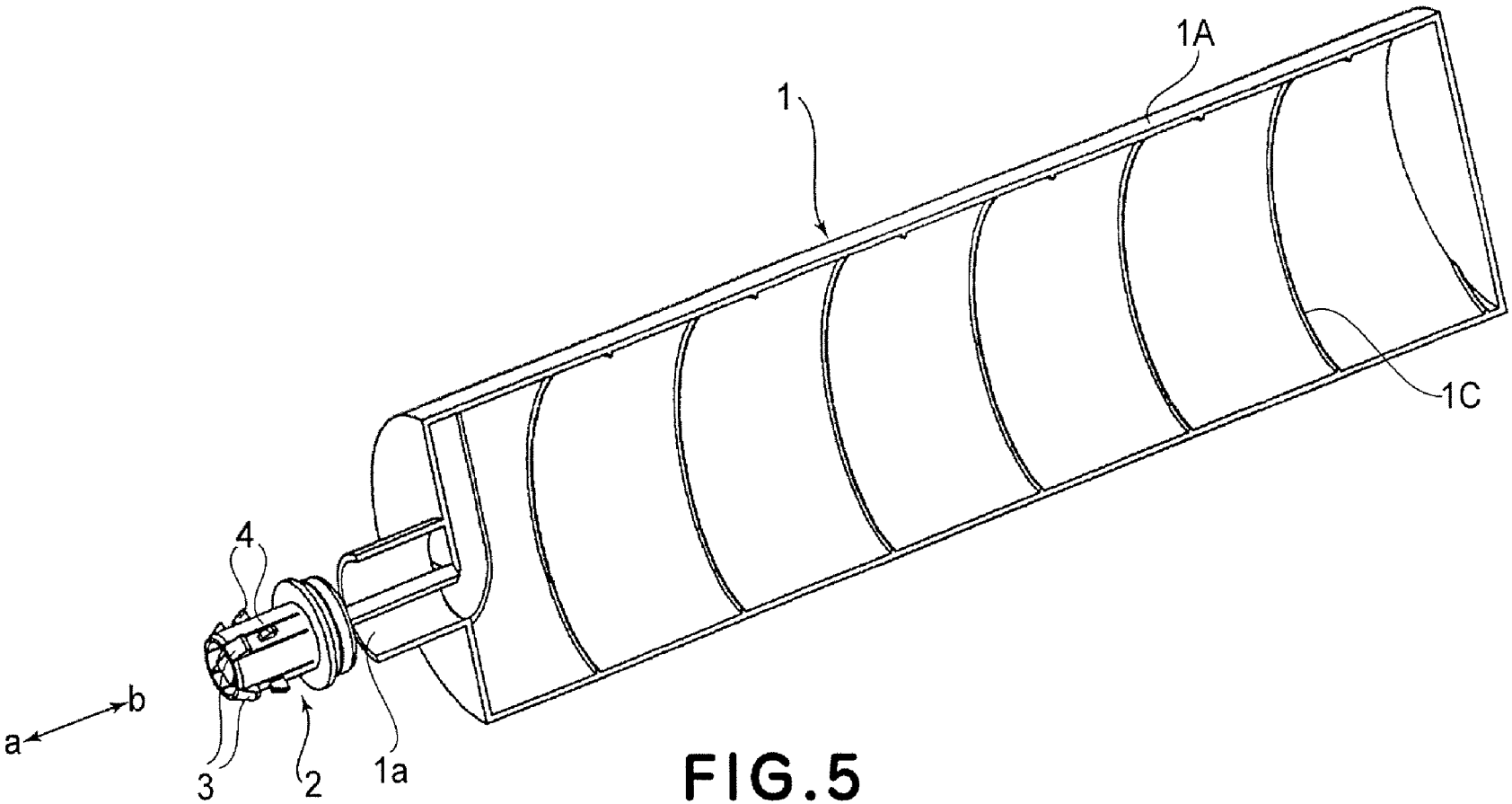
FIG. 5 is a sectional perspective view in the case where a feeding member in a developer supply container is a spiral projection.
Figure 6:
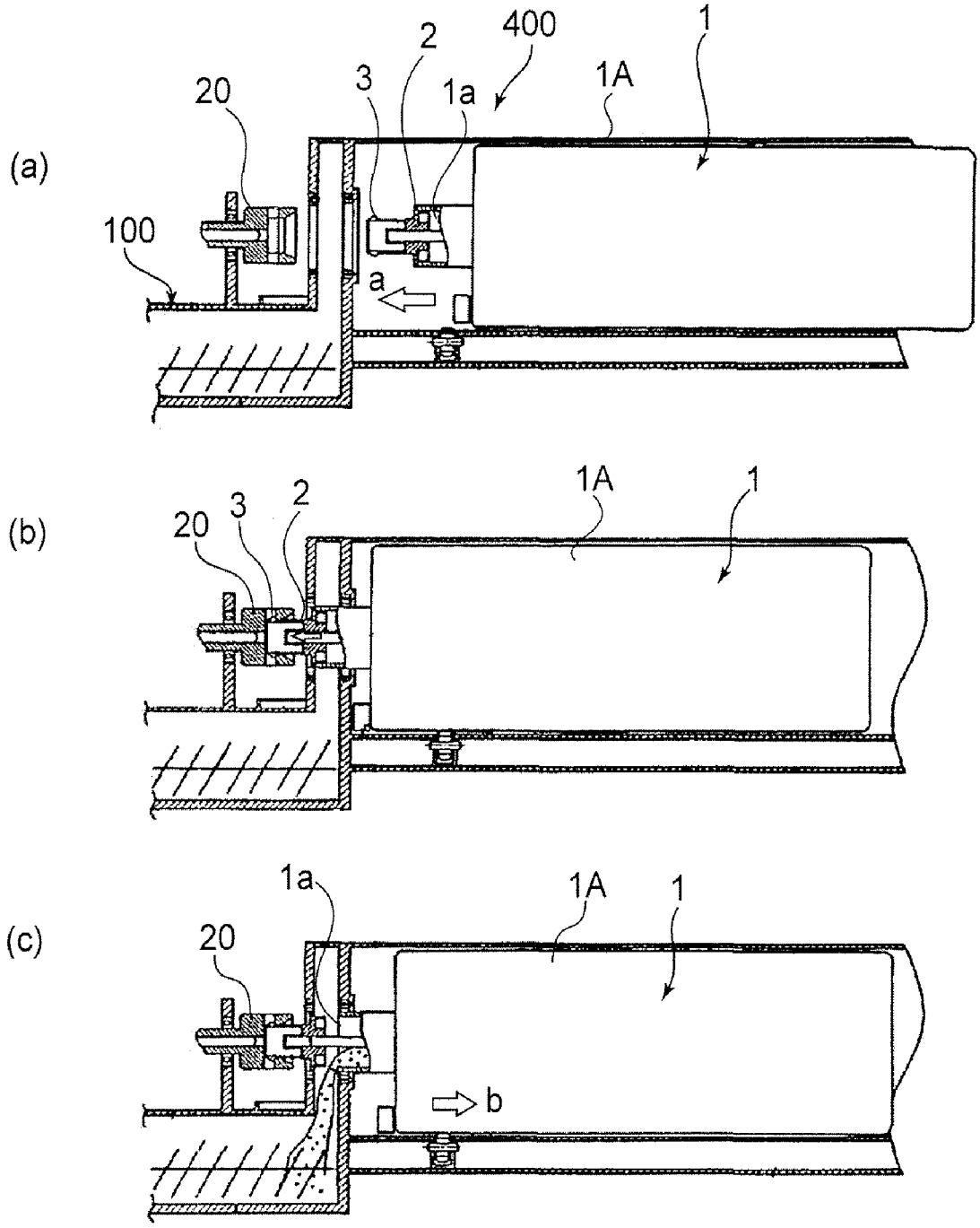
FIGS. 6(*a*), 6(*b*) and 6(*c*) are sectional explanatory views of an replacement operation of a developer supply container.
Figure 7:
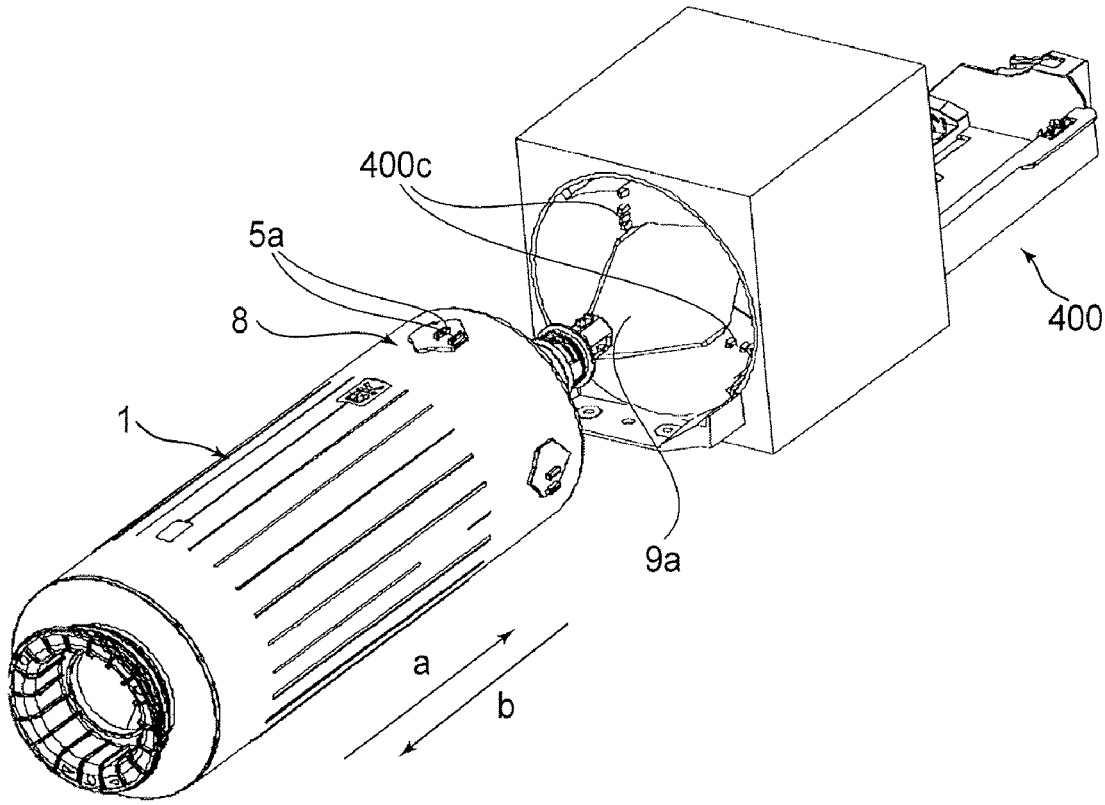
FIG. 7 is a perspective view showing a guiding portion and a regulation member provided in a developer receiving apparatus and a lead portion and a regulation portion provided to a developer supply container.

FIGS. 3(*a*) and 3(*b*) are perspective views of a developer supply container 1 viewed from an opening 1*a* side (FIG. 3(*a*)) and an opposite side (FIG. 3(*b*)). FIG. 4 is a perspective sectional view in the case where a feeding member in the developer supply container 1 is a baffle member 40. FIG. 5 is a perspective sectional view in the case where the feeding member in the developer supply container 1 is a spiral projection 1*c*. FIGS. 6(*a*), 6(*b*) and 6(*c*) are sectional views for illustrating a replacing operation of the developer supply container 1. FIG. 7 is a perspective view showing a guiding portion and an adaptation portion in a developer receiving apparatus 400 and a lead portion and a regulation portion provided to the developer supply container 1.

The developer supply container 1 has a substantially cylindrical container body 1A for containing developer. At an almost center of one end surface of the container body 1A in a longitudinal direction of the developer supply container 1, an opening portion (discharge opening) 1*a* having a diameter smaller than that of the cylindrical portion is provided in a projected condition. At the opening portion 1*a*, a sealing member 2 for closing the opening portion 1*a* is provided and, as will be understood from explanation with respect to FIGS. 3(*a*) and 3(*b*) described later, is slidely moved in a rotation axis direction (arrow a-b direction) of the developer supply container 1, whereby an open/close operation of the opening portion 1*a* is performed.

In this embodiment, the rotation axis direction of the developer supply container 1 is in parallel to the longitudinal direction of the developer supply container 1 and a mounting/removal direction of the developer supply container 1 with respect to the image forming apparatus.

Incidentally, due to a production error or an assembly error of the developer supply container or the image forming apparatus, parallelism of the rotation axis direction of the developer supply container with respect to the longitudinal direction of the developer supply container or the mounting/removal direction of the developer supply container with respect to the image forming apparatus may be changed by a degree of play. More specifically, the rotational axis direction of the developer supply container may be substantially parallel to the longitudinal direction of the developer supply container or the mounting/removal direction of the developer supply container with respect to the image forming apparatus.

The sealing member 2 has a cylindrical portion, as a coupling portion, and is provided with an engaging projection 3 as a hook portion engageable with a drive portion 20 (FIGS. 6(*a*) to 6(*c*)) of the apparatus main assembly and a release projection 4 as a release portion for releasing the engagement of the engaging portion 3 with the drive portion 20.

An area of the cylindrical portion in which the engaging portion 3 and the release portion 4 are supported is constituted to be elastically deformable. More specifically, in order to assist or promote the elastic deformation, at both ends of the area, slits extended to an end of the cylindrical portion are provided. The engaging projection 3 has a (release prevention) function of engaging the sealing member 2 with the apparatus main assembly (driving portion) in the rotation axis direction of the developer supply container 1 by being hook-engaged in a hole portion provided in the driving portion 20 of the apparatus main assembly and a function of receiving a rotational driving force from the apparatus main assembly (driving portion) in combination.

Next, a constitution of the inside of the developer supply container 1 will be described. As described above, the developer supply container 1 has the substantially cylindrical shape and is configured to receive the rotational driving force from the apparatus main assembly 100 to be rotated by being horizontally disposed in the apparatus main assembly (as shown in FIG. 2). Further, inside the developer supply container 1, as described above, the baffle member 40 (FIG. 4) as the feeding portion of the developer is disposed. The baffle member 40 is, as shown in FIG. 4, provided with a partition wall 40*b* for raising the developer in the developer supply container 1 by the rotation of the developer supply container 1 and an inclined projection 40*a*, disposed on the partition wall 40*b*, for feeding the developer raised by the partition wall 40*b* to the opening portion 1*a*. More specifically, the developer in the developer supply container 1 is raised by the partition wall 40*b* by the rotation of the developer supply container 1 and slides down the partition wall 40*b* by gravity. Thereafter, the developer is fed in the rotation axis direction by the inclined projection 40*a* having a surface inclined with respect to the rotation axis direction and is finally discharged from the opening portion 1*a* provided at one end surface of the developer supply container 1. According to this constitution, it is possible to perform feeding and stirring of the developer at a high level.

Further, as shown in FIGS. 3(*a*) and 3(*b*), at an outer peripheral (circumferential) surface of the developer supply container 1 in the neighborhood of a downstream side of the mounting direction (the arrow a direction) of the developer supply container 1, i.e., at an outer peripheral surface of the container end portion in the neighborhood of the opening portion 1*a*, the regulation portion 5 as an adaptation portion is provided. On the other hand, in the developer receiving apparatus 400, an associated regulation member 400*c* as an adaptation member is disposed (FIG. 7). As described later, the regulation portion 5 and the regulation member 400*c* are used for determines whether or not the developer supply container 1 is mountable to the developer receiving apparatus 400 on the basis of their mutual adaptation relationship.

The regulation portion 5 is constituted by a plurality of regulation projections (projection portions) 5*a* providing from the outer peripheral surface of the cylindrical portion of the container body 1A. More specifically, by appropriately setting combinations of, e.g., the number and arrangement of the regulation projections 5*a* for each different type of developer supply container, the regulation portion 5 functions as an identifier of the developer supply container 1. By the combination of the regulation projections 5*a* of the developer supply container 1 and the regulation member 400*c* of the developer receiving apparatus 400, only a developer supply container containing a proper developer which causes no image defect and no color error with respect to the image forming apparatus main assembly 100 is mountable in the image forming apparatus main assembly 100. Details of this constitution will be described later.

Incidentally, as a constitution for feeding the developer contained in the developer supply container 1, other than the constitution using the baffle 40 shown in FIG. 4, the constitution is not particularly limited in shape and structure so long as it can feed the developer toward the discharge opening (opening portion 1*a*) by the rotation of the developer supply container 1. For example, as shown in FIG. 5, it is also possible to employ a constitution using a spiral projection 1*a* provided at an inner peripheral surface of the developer supply container 1. It is possible to feed the developer by the rotation of the developer supply container 1 also based on this constitution.

(Replacing Method of Developer Supply Container)

Next, a replacing method of the above described developer supply container 1 will be described. During a process of image formation, when the developer in the developer supply container 1 is substantially fully consumed, an empty state of the developer in the developer supply container 1 is detected by developer supply container empty state detection means (not shown) and notification to that effect is provided to a user through the display means 100*b* (FIG. 2) such as a liquid crystal display panel or the like. In this embodiment, replacement of the developer supply container 1 is performed by the user himself (herself). The procedure thereof is as follows.

First of all, a replacement cover 15 in a closed state is rotationally moved around a hinge 18 to be opened to a position shown in FIG. 2. With the opening operation of the replacement cover 15, the container body (cylindrical portion) 1A in a state shown in FIG. 6(*c*) is moved in a direction of an arrow a shown in FIG. 6(*a*) by an open/close means (not shown). As a result, the sealing member 2 which has been apart from the container body 1A and is in a state in which the opening portion is opened is pressed and engaged into the opening portion 1*a* of the developer supply container 1, so that the opening portion 1*a* is closed and sealed and the developer supply container 1 is placed in a state shown in FIG. 6(*b*).

Then, the user pulls out the developer supply container 1, which is mounted in the apparatus main assembly 100 and in which there is no developer, in a direction opposite from the arrow a direction shown in FIG. 6(*a*) to remove the developer supply container 1 from the apparatus main assembly 100. Thereafter, the user inserts a new developer supply container 1 in the arrow a direction shown in FIG. 6(*a*) and then closes the replacement cover 15. Then, as described above, with the closing operation of the replacement cover 15, the sealing member 2 is moved apart from the container body 1A by a developer supply portion open/close means (not shown) to unseal the opening portion 1*a* of the developer supply container 1 (FIG. 6(*c*)). The replacement procedure of the developer supply container 1 is as described above.

(Constitution for Determining Whether or not Developer Supply Container is Mountable)

In the above described replacement of the developer supply container 1, erroneous setting (mounting) of a developer supply container 1 containing a different type of developer into an image forming apparatus main assembly 100 must be avoided. Hereinbelow, a mechanism, for determining whether or not the developer supply container 1 is mountable, which is used for preventing the erroneous setting will be described more specifically with reference to the drawings.

As shown in FIGS. 3(*a*) and 3(*b*), the developer supply container 1 of this embodiment, at an end portion (at the outer peripheral surface in the neighborhood of the discharge opening 1*a* in this embodiment) in the insertion direction of the container body 1A (in the arrow a direction), the regulation portion 5 (the regulation projections 5*a*) as the adaptation portion protruding from the cylindrical portion of the developer supply container body 1A is provided. This regulation portion 5 is disposed at four positions which are substantially equally spaced on the outer peripheral surface of the container body 1A.

On the other hand, as described above, the regulation member 400*c* as the adaptation member for permitting or blocking the mounting of the developer supply container 1, i.e., for determining mechanically whether or not the developer supply container 1 is mountable, on the basis of an adaptation relationship with the regulation portion 5 is disposed in the developer receiving apparatus 400 (FIG. 7). This regulation member 400*c* is also disposed at four positions which are substantially equally spaced on the inner peripheral surface of the developer receiving apparatus 400 (FIG. 9(*b*)).

Figure 9:
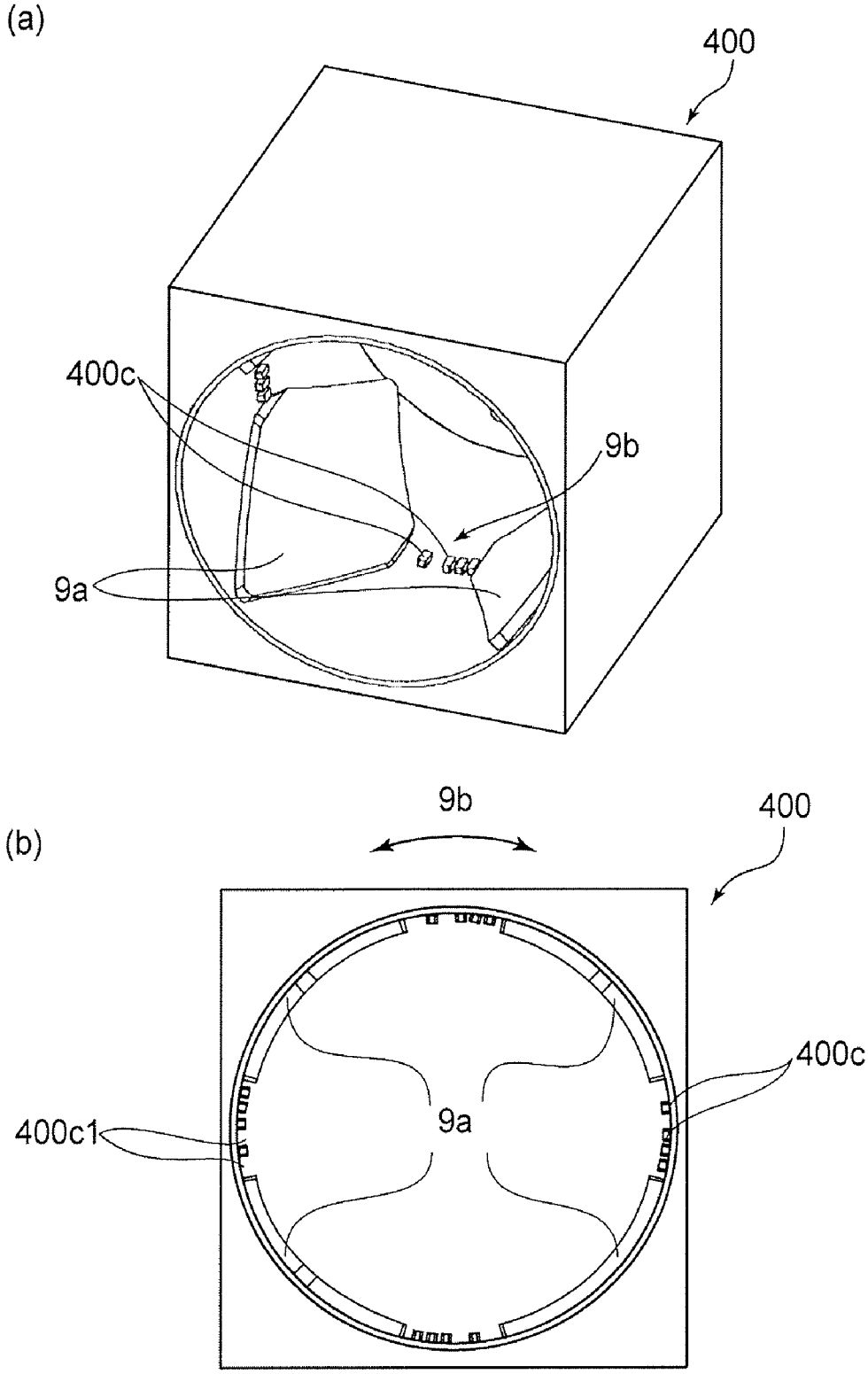
FIGS. 9(*a*) and 9(*b*) are a perspective view and a plan view, respectively, showing a guiding portion and a regulation member provided in a developer receiving apparatus.

The regulation member 400*c* is disposed in such a state that it has a cutting portion 400*c*1, varying depending on a developer supply container 1 different in color or type depending on the developer used in the image forming apparatus main assembly 100, (which is virtually referred to as the cutting portion even in the case where the developer receiving apparatus 400 which is integrally molded partially has a recess portion as shown in FIG. 9(*b*)). In this embodiment, such a constitution that a determination as to whether or not the developer supply container 1 is mountable into the image forming apparatus main assembly 100 is made by determining whether or not the shape of the regulation member 400*c* is substantially coincident with that of the regulation projections 5*a* as the regulation portion 5 provided to the developer supply container 1 is employed.

Here, when the regulation portion 5 provided to the developer supply container 1 and the regulation member 400*c* provided in the developer receiving apparatus 400 are out of phase (in a direction of rotation of the developer supply container 1 about the rotation axis substantially in parallel to the mounting direction of the developer supply container 1), a proper determination as to whether or not the developer supply container 1 is mountable in the image forming apparatus main assembly 100 cannot be performed. For this reason, in this embodiment, a phase adjusting means for causing the regulation portion 5 of the developer supply container 1 and the regulation member 400*c* of the developer receiving apparatus 400 to have the same phase is provided. A constitution of the phase adjusting means for adjusting the phases of the regulation portion 5 and the regulation member 400*c* so that they are in phase with each other will be described more specifically with reference to FIGS. 8 to 10.

Figure 8:
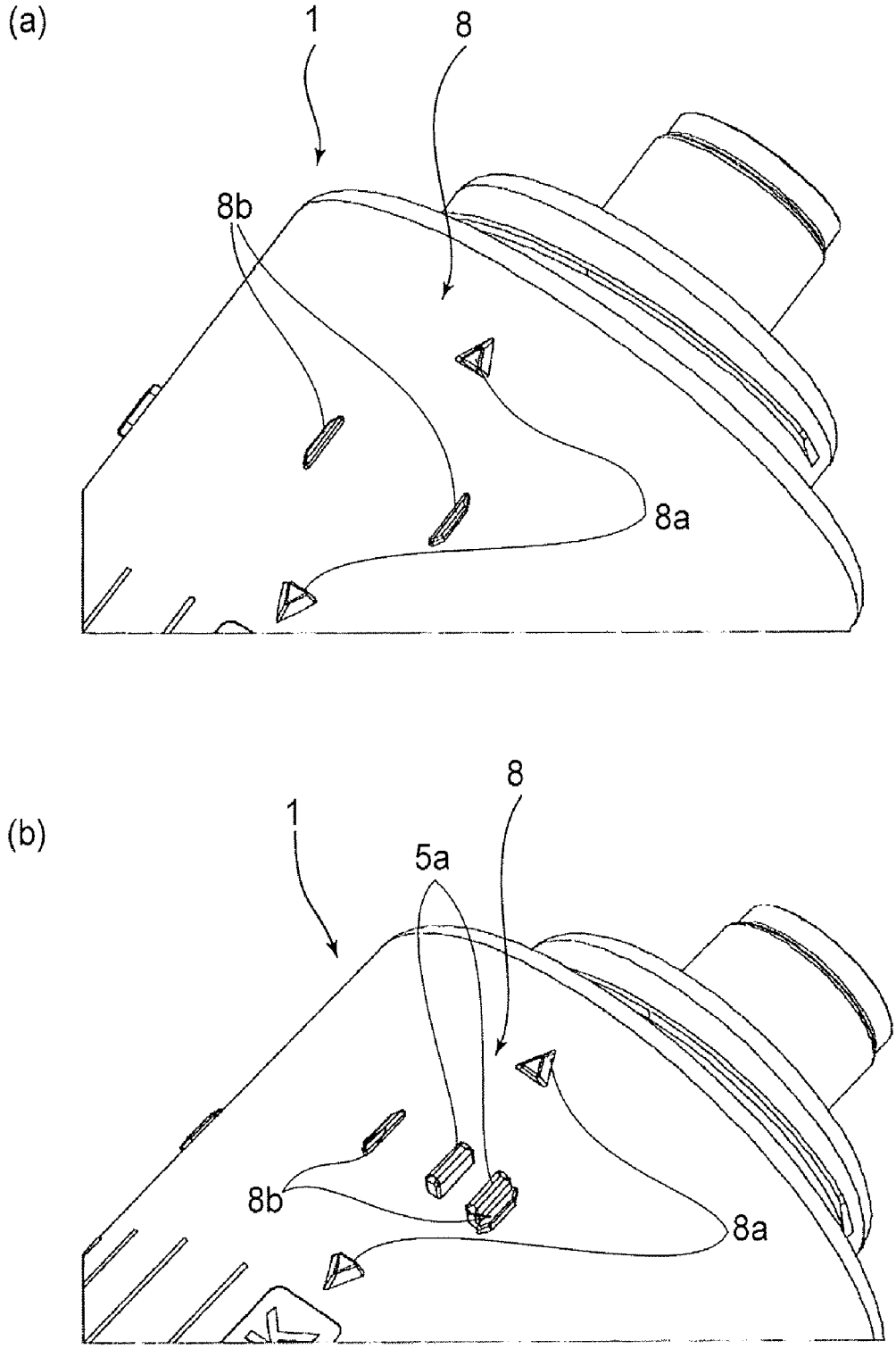
FIGS. 8(*a*) and 8(*b*) are enlarged views each showing a principal portion including a lead projection, a positioning projection, and a regulation portion provided to a developer supply container.
Figure 10:
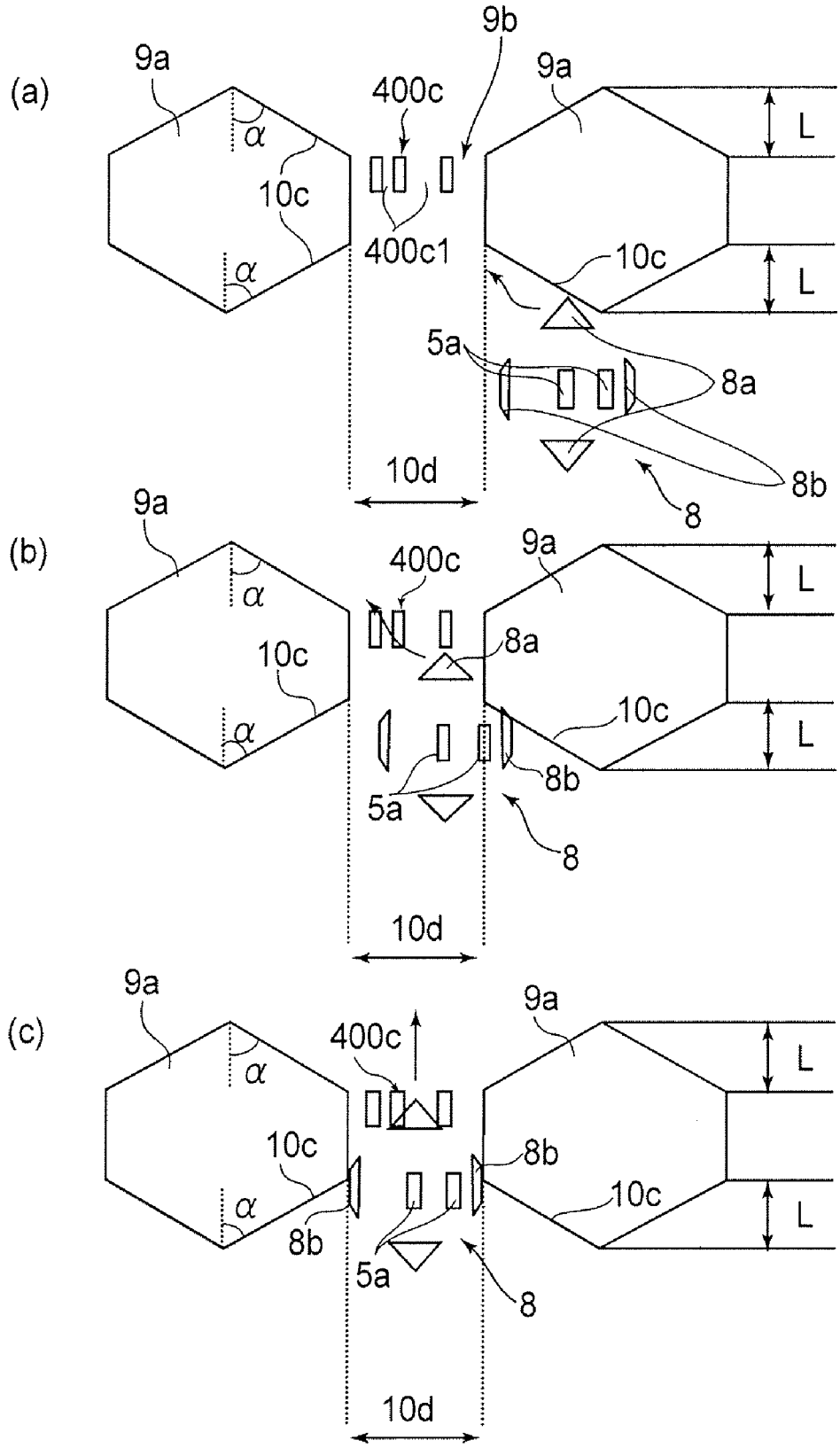
FIGS. 10(*a*), 10(*b*) and 10(*c*) are schematic explanatory views showing a relationship between a guiding portion and a lead portion during mounting of a developer supply container.

FIG. 8(*a*) is a partially enlarged view of a principal portion of the developer supply container, in which a lead portion 8 is divided into a lead projections 8*a* and positioning projections 8*b*, is shown. FIG. 8(*b*) is a partially enlarged view of a principal portion of the developer supply container, in which a regulation projection 5*a* and the lead portion 8 divided into the lead projections 8*a* and the positioning projections 8*b* are shown. FIG. 9(*a*) is a perspective view showing the guiding portion and the adaptation portion in the developer receiving apparatus, and FIG. 9(*b*) is a plan view thereof. FIGS. 10(*a*), 10(*b*) and 10(*c*) are schematic explanatory views showing a relationship between the guiding portion and the lead portion during mounting of the developer supply container.

As shown in FIGS. 8(*a*) and 8(*b*), the lead portion 8 is provided. The lead portion 8 is regulated by the guiding portion 9*a* as a guide member of the developer receiving apparatus 400 and includes the lead projection 8*a* and the positioning projection 8*b*.

In the developer receiving apparatus 400, as shown in FIGS. 9(*a*) and 9(*b*), the guiding portion 9*a* as the guide member is provided. The guiding portion 9*a* is used for rotating the developer supply container by running into the projection to be introduced 8*a* with the insertion and mounting operation of the developer supply container 1. More specifically, the guiding portion 9*a* functions as a guide for oppositely disposing the regulation portion 5 and the regulation member 400*c* to each other (for introducing the regulation portion 5 toward a gate portion 9*b*) by running into the lead projection 8*a* with the insertion and mounting operation of the developer supply container 1.

Further, the gate portion 9*b* is used to position the positioning projection 8*b* of the lead portion 8. More specifically, the gate portion 9*b* and the positioning projection 8*b* have a function of maintaining a state in which the regulation portion 5 and the regulation member 400*c* are located opposite to each other during the inserting and mounting operation (during passing of the regulation portion 5 through the regulation member 400*c*).

Incidentally, in this embodiment, in order to functionally explain the lead portion 8, such a state that the lead portion 8 is divided into the lead projection 8*a* and the positioning projection 8*b* is illustrated as shown in FIGS. 8(*a*) and 8(*b*). However, as shown in FIG. 7, the lead portion 8 may be one having such a shape that both the projections are integrally formed. The lead portion 8 as the lead portion is, as shown in FIG. 7, a projection portion having an inclined surface with respect to the rotation axis direction of the developer supply container 1.

As described above, in this embodiment, in the rotation direction around the rotation axis line substantially in parallel to the mounting direction of the developer supply container 1 (the arrow a direction shown in FIG. 7), it is possible to rotationally move the lead portion 8 toward the guiding portion 9*a* with the insertion and mounting operation of the developer supply container 1 even when the developer supply container 1 is inserted into the developer receiving apparatus 400 at any phase of 360 degrees.

As a result, the developer receiving apparatus 400 (the regulation member 400*c*) and the developer supply container 1 (the regulation portion 5) are in phase with each other. Thereafter, when the insertion and mounting operation of the developer supply container 1 is further continued, a mechanical judgement of adaptability of the regulation member 400*c* and the regulation portion 5 is made. More specifically, when the adaptability of the regulation portion 5 to the regulation member 400*c* is fulfilled, it is possible to continue the insertion and mounting of the developer supply container 1, so that the mounting operation of the developer supply container 1 is finally completed. On the other hand, in the case where the adaptability of the regulation portion 5 to the regulation member 400*c* is not fulfilled, the regulation member 400*c* is an interference member for the regulation portion 5. As a result, a further insertion and mounting operation of the developer supply container 1 is mechanically blocked, so that it is possible to readily recognize that the developer supply container 1 is not a proper developer supply container.

Figure 11:
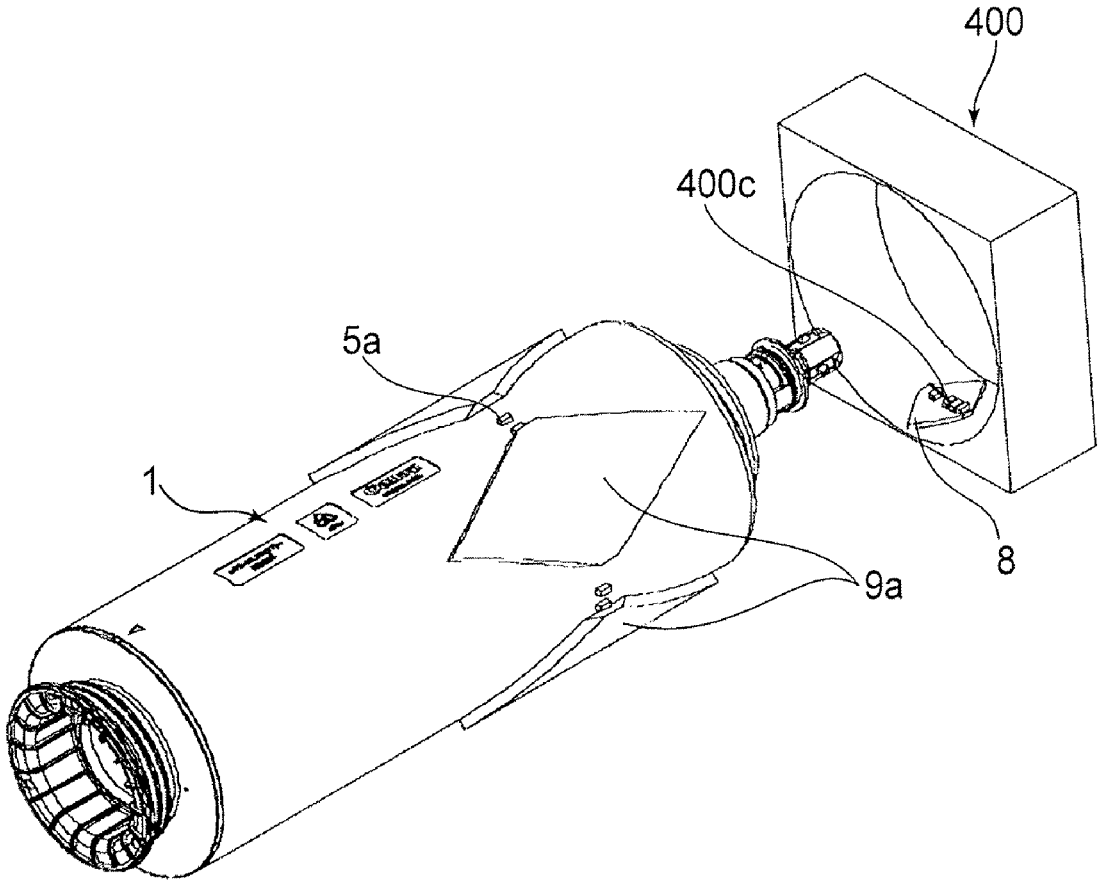
FIG. 11 is a perspective view showing an embodiment in which a lead portion is provided to a developer supply container and a guiding portion is provided in a developer receiving apparatus.

Further, in the above-described embodiment, such a constitution that the developer supply container 1 is provided with the lead portion 8 and the developer receiving apparatus 400 is provided with the guiding portion 9*a* is described but the present invention is not limited thereto. It is also possible to adopt a modified embodiment as shown in FIG. 11. More specifically, as shown in FIG. 11, it is also possible to adopt such a constitution that a developer supply container 1 is provided with a guiding portion 9*a* and a developer receiving apparatus 400 is provided with a lead portion 8. The same effect is achieved by such a constitution. Incidentally, this is true for constitutions in embodiments, described later, other than this embodiment.

Next, with reference to FIGS. 10(*a*), 10(*b*) and 10(*c*), details of an operation of phase alignment (adjustment) between the regulation member 400*c* and the regulation portion 5 (regulation projections 5*a*) by the guiding portion 9*a* and the lead portion 8, which constitute the above described phase adjusting means (guide means), will be described.

First, insertion and mounting of the developer supply container 1 will be explained.

As also described in the replacement method of the developer supply container 1, the developer supply container 1 is inserted in the direction of an arrow a indicated in FIG. 7. When the regulation member 400 and the regulation portion 5 are out of phase as shown in FIG. 10(*a*), i.e., when a phase of the lead projection 8*a* is deviated from an area 10*d* of the gate portion 9*b* formed between adjacent guiding portions 9*a* (hereinafter, referred to as a "gate area"), the projection to be introduced 8*a* abuts against a tapered portion 10*c* as an inclination portion of the guiding portion 9*a*, so that the regulation portion 5 is rotated together with the developer supply container 1 relative to the regulation member 400*c*.

Thereafter, when the developer supply container 1 is further inserted and the lead projection 8*a* enters the gate area 10*d* as shown in FIG. 10(*b*), an end of the positioning projection 8*b* abuts against the guiding portion 9*a*, so that the regulation portion 5 is further rotated relative to the regulation member 400*c*.

Further, as shown in FIG. 10(*c*), when the positioning projection 8*b* enters the gate portion 9*b* located between the adjacent guiding portions 9*a*, a positional relationship between the developer supply container 1 and the developer receiving apparatus 400 in the rotation direction of the developer supply container 1 is kept so that the regulation portion 5 and the regulation member 400*c* are out of phase.

Thereafter, the developer supply container 1 is moved only in the insertion and mounting direction (the arrow a direction of FIG. 7) without being substantially rotated relative to the developer receiving apparatus 400.

As described above, the developer supply container 1 is further inserted in such a state that the regulation portion 5 and the regulation member 400*c* are in phase with each other, so that determination as to whether or not the developer supply container 1 is mountable is performed by whether or not the regulation member 400*c* and the regulation portion 5 stand in a corresponding relationship.

As described above, according to this embodiment, by a simple constitution, it is possible to reliably perform the determination as to whether or not the developer supply container 1 is mountable even when an operator does not perform a phase-adjusting operation consciously. Further, the mounting of the developer supply container 1 can be readily performed with reliability.

Next, a removal (demounting) operation of the developer supply container 1 from the developer receiving apparatus 400 will be described.

The developer supply container 1 is, as described above, configured to feed and discharge developer by its own rotation. Further, at the time of completion of the mounting operation of the developer supply container 1, the regulation portion 5 is located downstream from the regulation member 400*c* in the mounting direction of the developer supply container 1 so as not to be subjected to interference with the regulation member 400*c*. Further, the developer supply container 1 is rotated by the developer supply operation but at the time of completion of the developer supply operation, a rotation stop position of the developer supply container 1 can be changed to various positions.

Accordingly, at the time of start of the removal (demounting) operation of the developer supply container 1, there is such a case where the regulation member 400*c* and the regulation portion 5 are out of phase. In such a case, there is a possibility that the developer supply container 1 cannot be pulled out of the image forming apparatus main assembly 100 by interference of the regulation member 400*c* with the regulation portion 5. In this embodiment, in order to solve such a problem, also during the removal operation of the developer supply container 1, the regulation member 400*c* and the regulation portion 5 are configured to be in phase with each other.

More specifically, the guiding portion 9*a* and the lead portion 8 are configured so that the regulation portion 5 is rotated together with the container body relative to the regulation member 400*c* in order that the regulation portion 5 and the regulation member 400*c* can be in phase with each other not only during the mounting of the developer supply container 1 in the image forming apparatus main assembly 100.

More specifically, as shown in FIGS. 7 and 10, the guiding portion 9*a* and the lead portion 8 as the phase alignment means have symmetrical shapes in the insertion direction (arrow a direction shown in FIG. 7) and the removal direction (arrow b direction shown in FIG. 7) through the regulation member 400*c* and the regulation portion 5 which constitute the determining mechanism determining whether or not the developer supply container 1 is mountable. As a result, also during the removal operation of the developer supply container 1, the regulation member 400*c* and the regulation portion 5 have the same phase without the operator consciously performing the phase adjusting operation, so that it is possible to smoothly pull the developer supply container 1 out of the image forming apparatus main assembly 100.

Incidentally, as shown in FIGS. 10(*a*) to 10(*c*), a guiding angle α of the guiding portion 9*a* (an angle of the tapered portion 10*c* with respect to the insertion direction) affects an operation force during the insertion of the developer supply container 1. More specifically, with a smaller guiding angle α, an amount of rotation of the guiding portion 9*a* and the lead portion 8 relative to an amount of movement of the developer supply container 1 in the insertion and mounting direction is smaller, so that the developer supply container 1 is liable to be inserted. However, as the guiding angle α is smaller, a length L of the guiding portion 9*a* (in the developer supply container insertion direction) is longer. For this reason, the guiding angle α and the length L of the guiding portion 9*a* may preferably be set in view of a balance between the operation force of the developer supply container 1 and a mounting (setting) space of the guiding portion 9*a*.

A similar function is performed even in the case where only a pair of a regulation portion 5 and a regulation member 400*c* are provided and only one guiding portion 9*a* having a rhombus shape is provided. In this case, however, the developer supply container 1 is rotated relative to the developer receiving apparatus 400 at a rotation angle up to 180 degrees. Further, the length L of the guiding portion 9*a* in the developer supply container insertion direction is required correspondingly when the guiding angle α (as shown in FIG. 10(*a*)) is decreased in order to reduce the operation force.

For this reason, in this embodiment, as shown in FIGS. 9(*a*) and 9(*b*), a plurality of guiding portions 9*a* are provided in order to create a plurality of gate portions 9*b*.

By such a constitution, an amount of relative rotation between the guiding portion 9*a* and the lead portion 8 can be reduced and it is also possible to shorten the length L of the guiding portion 9*a* in the developer supply container insertion direction while keeping the introduction angle α for decreasing the operation force.

In this embodiment, the developer supply container 1 and the lead portion 8 are configured to be integrally rotated, so that the developer supply container 1 itself is rotated during the insertion thereof. When the developer supply container 1 is inserted continuously, it is automatically rotated depending on an amount of insertion until the regulation member 400*c* and the regulation portion 5 are in phase with each other. In this case, a hand of the user (operator) is also rotated together with the developer supply container 1. When the amount of rotation is too large, there is a possibility that the user feels physical disorder in the mounting operation.

In this embodiment, the gate portion is disposed at four positions, so that the developer supply container 1 and the developer receiving apparatus 400 are configured to be rotated relative to each other at an angle up to 45 degrees during the mounting of the developer supply container 1 in the developer receiving apparatus 400.

Incidentally, from a viewpoint of operability, the developer supply container 1 may preferably have a relative rotation angle (maximum value) of not more than 60 degrees (corresponding to three or more gate portions) during the mounting operation. In this case, the developer supply container 1 may functionally have one lead portion 8 but may preferably have a plurality of lead portions 8 to be introduced at equal spacing on the circumferential surface of the developer supply container 1 when a balance of rotation is taken into consideration. However, there is a correlation between the number of guiding portions 9*a* provided in the developer receiving apparatus 400 and the number of lead portions 8 to be introduced provided to the developer supply container 1. More specifically, when one lead portion 8 is provided to the developer supply container 1, the number of the guiding portions 9*a* for the developer receiving apparatus 400 may appropriately be selected. However, in the case of two or more lead portion 8, the number of the guiding portions 9*a* may preferably be an integral multiple of the number of lead portions 8.

Here, with respect to a positional relationship of the regulation member 400*c* with the guiding portion 9*a* and that of the regulation portion 5 with the lead portion 8, when the guiding portion 9*a* and the lead portion 8 are in phase with each other, the regulation member 400*c* and the regulation portion 5 may be in phase with each other.

Figure 12:
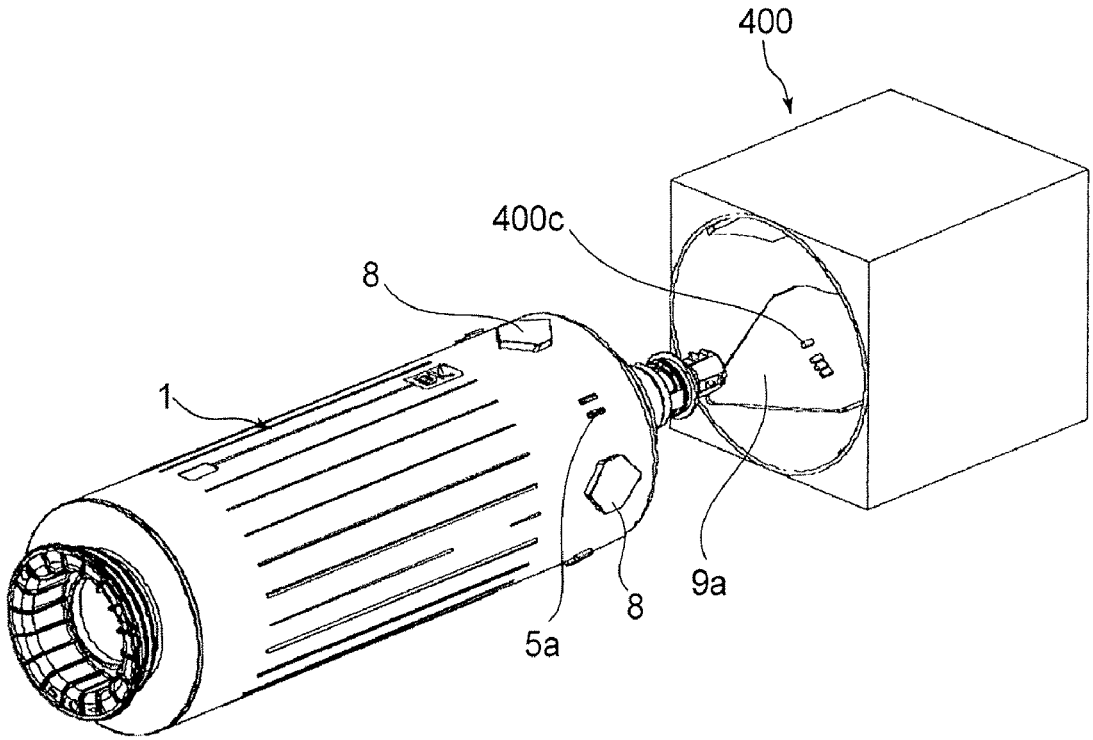
FIG. 12 is a perspective view showing an embodiment in which a regulation member is provided on a guiding portion and a regulation portion is provided between adjacent guiding portions.

For example, arrangement positions of the regulation member 400*c* and the regulation portion 5 may be at the gate portion as shown in FIGS. 9(*a*) and 9(*b*) and between two positioning projections 8*b* as shown in FIG. 8(*b*), respectively, (or in the case of using an integral-type lead portion 8, the regulation portion 5 is disposed on the lead portion 8 as shown in FIGS. 3(*a*), 3(*b*) and 9) or may be on the guiding portion 9*a* and between two lead portions 8, respectively, as shown in FIG. 12 as a modified embodiment.

Further, a positional relationship of the regulation member 400*c* with the developer receiving apparatus 400 and that of the regulation portion 5 with the developer supply container 1 may preferably be as follows.

On the precondition that the positional relationship of the regulation member 400*c* with the guiding portion 9*a* and the positional relationship of the regulation portion 5 with the lead portion 8 are kept, the position of the regulation member 400*c* in the developer receiving apparatus 400 may preferably be on an upstream side of the developer receiving apparatus 400 in the insertion and mounting direction of the developer supply container 1 (the arrow a direction shown in FIG. 7). On the other hand, the position of the regulation portion 5 on the developer supply container 1 may preferably be on a downstream side of the developer supply container 1 in the insertion and mounting direction of the developer supply container 1 (the arrow a direction shown in FIG. 7).

As a result, it is possible to perform the determination as to whether or not the developer supply container 1 is mountable at an early stage of the mounting operation of the developer supply container 1, so that even when the user erroneously inserts an improper developer supply container 1, the error is liable to be found early.

By employing the constitution as described above, it is possible to perform the phase adjusting operation of the regulation portion 5 with the regulation member 400*c* in synchronism with such a simple operation that the developer supply container 1 is inserted and mounted in the developer receiving apparatus 400.

In the case where a proper developer supply container 1 is inserted, it can be smoothly mounted by a simple operation. On the other hand, in the case where the erroneous developer supply container 1 is inserted, it is possible to recognize the error with reliability. In this case, even when the erroneous developer supply container 1 is intended to be mounted, the developer supply container 1 is not completely mounted in the developer receiving apparatus 1. As a result, the sealing member 2 which seals the opening portion 1*a* of the developer supply container 1 is not engaged with the developer receiving apparatus 400. Accordingly, the sealing member 2 cannot be erroneously operated or a driving force cannot be transmitted from the image forming apparatus main assembly 100 to the developer supply container 1. In other words, it is possible to reliably obviate such a problem that a different type of developer is supplied into the image forming apparatus main assembly 100.

Further, also during the removal of the developer supply container 1, it is possible to perform a phase adjusting operation of the regulation portion 5 with the regulation member 400*c* in synchronism with such a simple operation that the developer supply container 1 is pulled out of the developer receiving apparatus 400.

In other words, only by the operation for simply pulling the developer supply container 1 out of the developer receiving apparatus 400, the user can smoothly demount the developer supply container, so that it is possible to considerably improve the operability.

Further, according to the constitution of the developer receiving apparatus 400 used in this embodiment, the regulation member 400*c* in the developer receiving apparatus 400 is located on the upstream side in the insertion direction of the developer supply container 1 and the regulation portion 5 on the developer supply container 1 is located on the downstream side in the insertion direction of the developer supply container 1, so that it is possible to make the determination whether the developer supply container 1 is mountable or not at an early stage during the insertion of the developer supply container 1. As a result, it is possible to early cause the user to recognize whether the developer supply container 1 is mountable or not.

Second Embodiment

A second Embodiment of the present invention will be described in detail with reference to FIG. 13. In this embodiment, a general structure of a main assembly of image forming apparatus and a general constitution of a developer supply container are similar to those in First Embodiment, so that a detailed explanation thereof will be omitted. Further, in this embodiment, members or means having the same functions as those in First Embodiment are represented by the same reference numerals or symbols.

Figure 13:
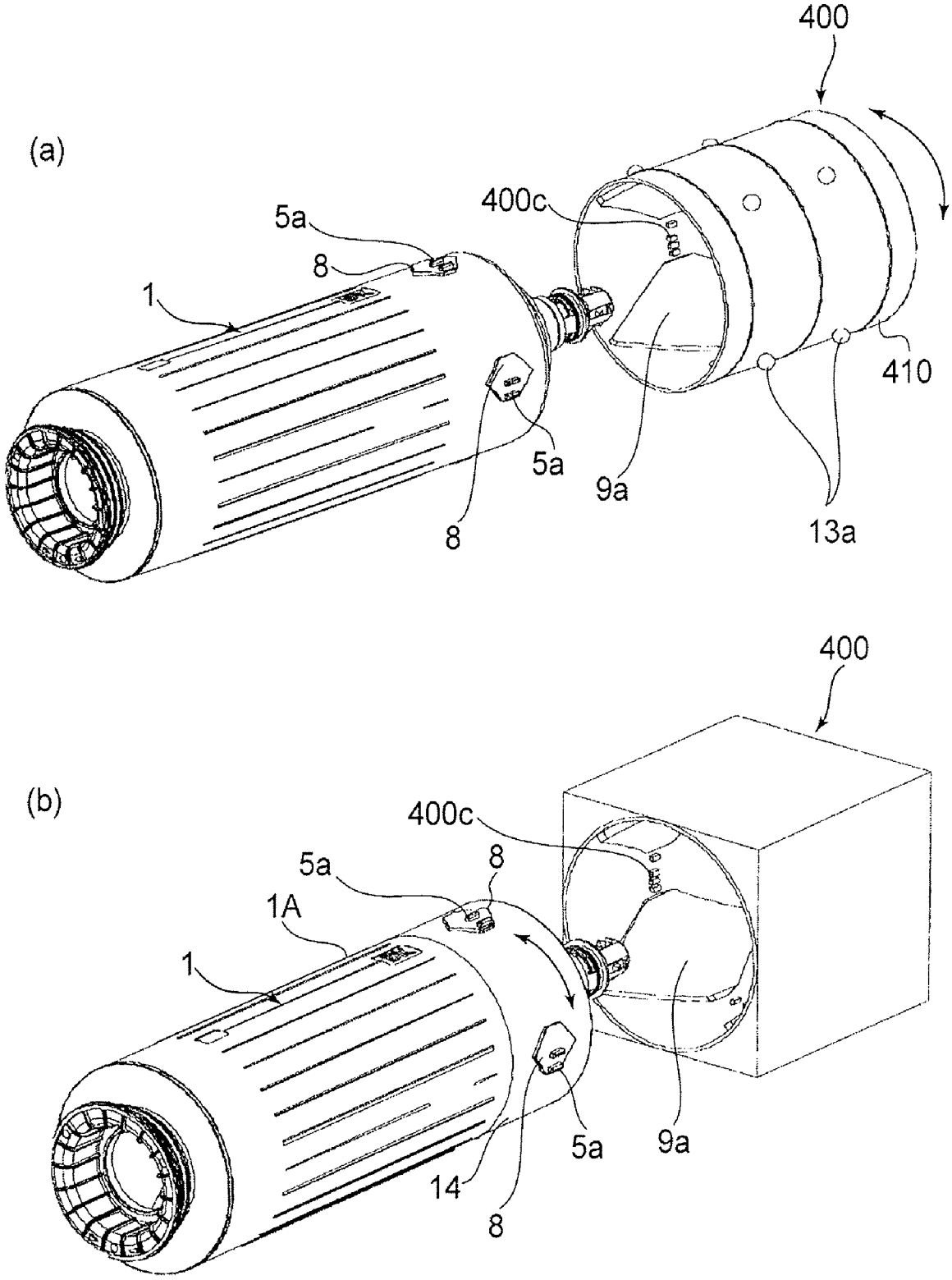
FIGS. 13(*a*) and 13(*b*) are perspective views each showing an embodiment in which either one of a combination of a guiding portion and a regulation member and a combination of a lead portion and a regulation portion is rotatably supported by either one of a developer receiving apparatus or a developer supply container.

FIGS. 13(*a*) and 13(*b*) are perspective views showing a developer receiving apparatus 400 and a developer supply container 1 according to Second Embodiment.

In this embodiment, either one of a combination of a guiding portion 9*a* and a regulation member 400*c* and a combination of a lead portion 8 and a regulation portion 5 is rotatably supported by either one of the developer receiving apparatus 400 and the developer supply container 1.

In FIG. 13(*a*), the guiding portion 9*a* and the regulation member 400*c* in the developer receiving apparatus 400 are provided in a rotation member 410 rotatably supported by rotation support rollers 13*a*. In other words, the guiding portion 9*a* and the regulation member 400*c* are configured to be rotationally movable along a rotation axis (line) substantially in parallel with a mounting (removal) direction of the developer supply container 1.

In FIG. 13(*b*), the lead portion 8 and the regulation portion 5 (regulating projections 5*a*) on the developer supply container 1 are provided on a rotation member 14 rotatable relative to a container body 1A. In other words, the lead portion 8 and the regulation portion 5 are configured to be rotationally movable along a rotation axis (line) substantially in parallel with the mounting (removal) direction of the developer supply container 1.

Even in the cases of a employing the above described constitutions shown in FIGS. 13(*a*) and 13(*b*), it is possible to achieve the same effects as in First Embodiment.

In addition, according to the constitutions (shown in FIGS. 13(*a*) and 13(*b*)) of this embodiment, the container body 1A is not rotated during a phase adjusting operation of the regulation portion 5 with the regulation member 400*c* performed with the mounting (removal) operation of the developer supply container 1, so that a hand of an operator grasping the container body 1A is not rotated. As a result, it is possible to further improve operability.

In this embodiment, an integral structure of the rotation member 410 with the guiding portion 9*a* and the regulation member 400*c* (FIG. 13(*a*)) or an integral structure of the rotation member 14 with the lead portion 8 and the regulation portion 5 (FIG. 13(*b*)) is configured to be rotatable only by engagement with the developer supply container 1, but it may be configured as any structure so long as the combination of the guiding portion 9*a* and the regulation member 400*c* or the combination of the lead portion 8 and the regulation portion 5 can be simultaneously rotated relative to the developer supply container 1 in essence. Further, in the constitution shown in FIG. 13(*a*), the rollers 13*a* are used as a rotation supporting portion but the present invention is not limited thereto. Basically, it is also possible to use any means (member) so long as it can rotatably support the combination of the guiding portion 9*a* and the regulation member 400*c* or the combination of the lead portion 8 and the regulation portion 5.

Figure 14:
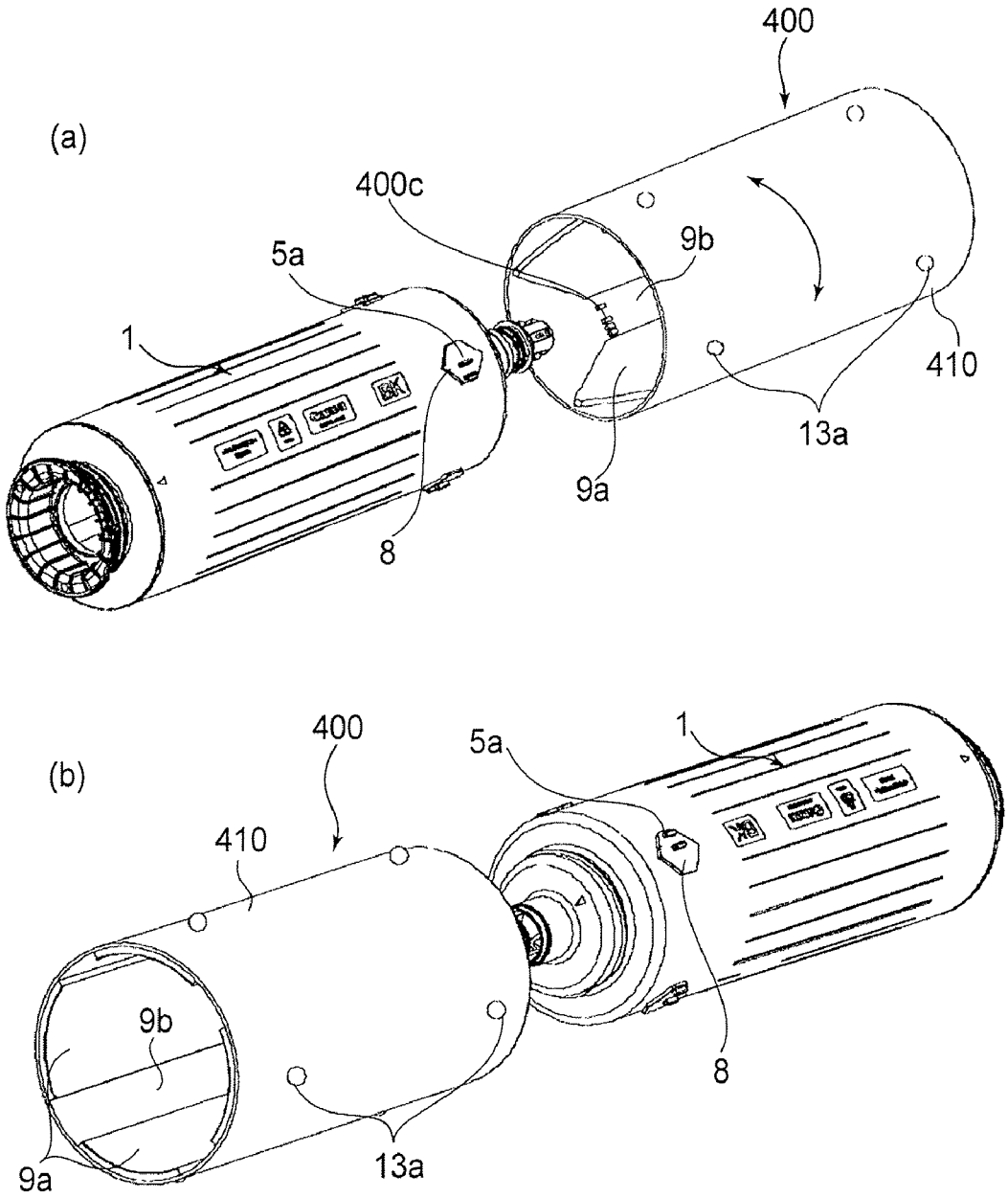
FIGS. 14(*a*) and 14(*b*) are perspective views each illustrating a constitution in which a developer supply container and a developer receiving apparatus are not out of phase with each other during rotation of the developer supply container after phase adjustment during mounting of the developer supply container.

A modified embodiment of Second Embodiment shown in FIG. 13(*a*) is shown in FIGS. 14(*a*) and 14(*b*).

FIGS. 14(*a*) and 14(*b*) are perspective views showing a developer receiving apparatus 400 and a developer supply container 1 viewed from an upstream side and a downstream side, respectively, in a mounting direction of the developer supply container 1.

In this modified embodiment shown in FIGS. 14(*a*) and 14(*b*), similarly as in the constitution shown in FIG. 13(*a*), the guiding portion 9*a* and the regulation member 400*c* in the developer receiving apparatus 400 are provided in a rotation member 410 rotatably supported by rotation support rollers 13*a*. In this manner, in the case where the guiding portion 9*a* and the regulation member 400*c* of the developer receiving apparatus 400 are rotatably supported by the rotation support rollers 13*a*, phase adjustment is only performed in the case where the developer supply container 1 is inserted as shown in FIGS. 14(*a*) and 14(*b*). More specifically, after the developer supply container 1 is mounted in the developer receiving apparatus 400, the guiding portion 9*a* and the regulation member 400*c* of the developer receiving apparatus 400 are integrally rotated by rotation of the developer supply container 1. As shown in FIGS. 14(*a*) and 14(*b*), a gate portion 9*b* of the guiding portion 9*a* is formed so that the lead portion 8 which is positionally aligned and supported by the gate portion 9*b* is guided to a most downstream portion of the developer receiving apparatus 400 in the insertion direction as it is.

According to this modified embodiment, the developer supply container 1 can be inserted into and removed from the developer receiving apparatus 400 without being rotated even when the user inserts the developer supply container 1 at any phase up to 360 degrees, so that it is possible to remarkably improve an operability of the developer supply container 1 in mounting and demounting operations.

The constitution of the gate portion 9*b* of the guiding portion 9*a* shown in FIGS. 14(*a*) and 14(*b*) is also applicable to the embodiment shown in FIG. 13(*b*) as another modified embodiment (not shown). In this case, after the developer supply container 1 is mounted in the developer receiving apparatus 400, in such a state that the lead portion 8 rotatably supported by the container body 1A of the developer supply container 1 is supported and fixed at the gate portion 9*b* of the guiding portion 9*a* in the developer receiving apparatus 400, the developer supply container body 1A is rotated relative to the lead portion 8 in order to supply the developer. For this reason, effects similar to those described above can be achieved.

Third Embodiment

A third Embodiment of the present invention will be described in detail with reference to FIG. 15. In this embodiment, a general structure of a main assembly of image forming apparatus and a general constitution of a developer supply container are similar to those in First Embodiment, so that a detailed explanation thereof will be omitted. Further, in this embodiment, members or means having the same functions as those in First Embodiment are represented by the same reference numerals or symbols.

Figure 15:
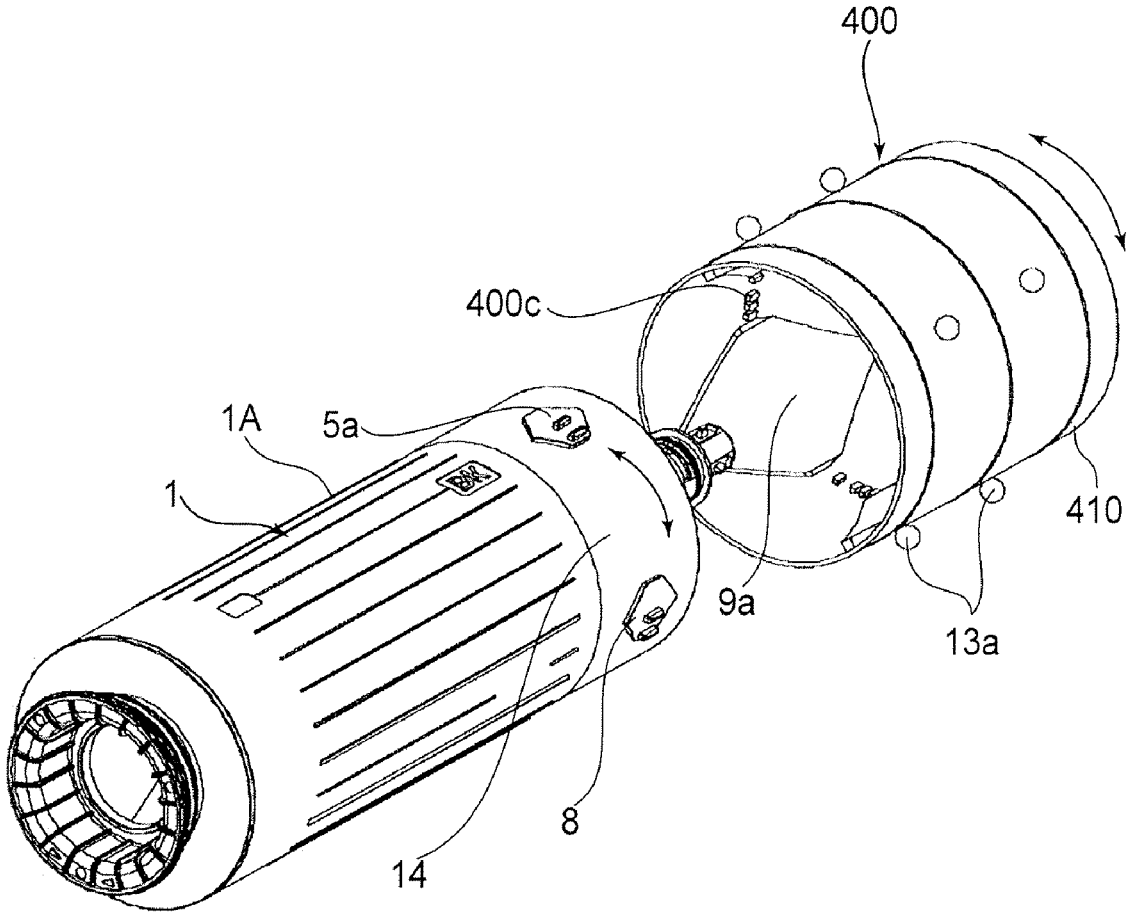
FIG. 15 is a perspective view showing an embodiment in which both of a combination of a guiding portion and a regulation member and a combination of a lead portion and a regulation portion are rotatably supported by a developer receiving apparatus and a developer supply container.

FIG. 15 is a perspective view showing a developer receiving apparatus 400 and a developer supply container 1 according to the Third Embodiment.

In this embodiment, both of a combination of a guiding portion 9*a* and a regulation member 400*c* and a combination of a lead portion 8 and a regulation portion 5 are rotatably supported by the developer receiving apparatus 400 and the developer supply container 1.

As shown in FIG. 15, the guiding portion 9*a* and the regulation member 400*c* in the developer receiving apparatus 400 are provided in a rotation member 410 rotatably supported by rotation support rollers 13*a*. Further, the lead portion 8 and the regulation portion 5 on the developer supply container 1 are provided on a rotation member 14 rotatable relative to a container body 1A. In other words, the guiding portion 9*a* and the regulation member 400*c* in the developer receiving apparatus 400 are configured to be rotatably around a rotation axis (line) substantially in parallel with a mounting direction of the developer supply container 1.

Similarly, the lead portion 8 and the regulation portion 5 on the developer supply container 1 are also configured to be rotatably around a rotation axis (line) substantially in parallel with the mounting direction of the developer supply container 1.

In this embodiment, an integral structure of the rotation member 410 with the guiding portion 9*a* and the regulation member 400*c* and an integral structure of the rotation member 14 with the lead portion 8 and the regulation portion 5 are configured to be rotatable only by engagement with the developer supply container 1, but may be configured as any structure so long as the combination of the guiding portion 9*a* and the regulation member 400*c* or the combination of the lead portion 8 and the regulation portion 5 can be simultaneously rotated relative to the developer supply container 1 in essence. Further, in the constitution shown in FIG. 13(*a*), the rollers 13*a* are used as a rotation supporting portion, but the present invention is not limited thereto. Basically, it is also possible to use any means (member) so long as it can rotatably support the combination of the guiding portion 9*a* and the regulation member 400*c* or the combination of the lead portion 8 and the regulation portion 5.

By employing the above described constitution, the guiding portion 9*a* and the lead portion 8 are rotated in such a direction that they are moved close to each other during the relative rotation for phase adjustment, so that an amount of rotation of the guiding portion 9*a* relative to the developer receiving apparatus 400 and an amount of rotation of the lead portion 8 relative to the developer supply container 1 can be decreased to ½ of those in the Second Embodiment.

Accordingly, an operation force during the mounting/removal operation of the developer supply container 1 can be further reduced when compared with the case of the Second Embodiment, thus further enhancing an operability.

In the above described embodiments, the developer supply container 1 is inserted and mounted in the developer receiving apparatus 400 by grasping the developer supply container 1 by the operator (user). It is also possible to adopt such a constitution that the developer supply container 1 is automatically moved in the mounting/removal direction by the developer receiving apparatus 400. More specifically, in this case, a sliding table on which the developer supply container 1 is to be placed, is automatically moved out of the image forming apparatus in synchronism with an opening operation of the open/close door 15 (FIG. 1) by the operator. Then, the operator pushes the sliding table on which the developer supply container is placed, and the sliding table is automatically retracted into the image forming apparatus. With the retraction operator operation of the sliding table, i.e., the mounting operation of the developer supply container 1 in which the container is mountable or not is made by a combination of the regulation portion 5 and the regulation member 400*c*. In the case where, the mounting of the developer supply container 1 is blocked, the developer supply container 1 cannot be further inserted, so that a load for driving the sliding table is large. When the increase in load required for driving the sliding table is detected by a load detector provided in the main assembly of image forming apparatus, movement of the sliding table is prohibited and an error notification to that effect is provided to the operator so that the operator can replace the developer supply container with a new one.

Further, in the embodiments described above, the lead portion 8 and the guiding portion 9*a* which have hexagonal shapes are used, but the shapes of the portions are not limited thereto. For example, these portions may also have other shapes such as an elliptical shape elongated in the insertion direction. Further, the lead portion 8 may be not only of the integral-type as shown in FIGS. 3(*a*) and 3(*b*), but also of a type in which both of the projections 8*a* and 8*b* are separately formed as shown in FIGS. 8 and 10.

In the above described embodiments, a single developer supply containers detachably mountable to the image forming apparatus is used but the number of developer supply container may appropriately be changed as desired. Further, the image forming apparatus in the above described embodiments is one capable of recording (forming) a monochromatic image, but may also be a color image forming apparatus capable of recording a color image. By using the developer supply container and the developer receiving apparatus according to the present invention in the above described image forming apparatuses, similar effects can be achieved.

Further, in the above described embodiments, the copying machine is used as the image forming apparatus, but the image forming apparatus to which the present invention is applicable is not limited to the copying machine. For example, it is also possible to use other image forming apparatuses including a printer, a facsimile apparatus, a composite machine having functions of these apparatuses, an image forming apparatus for successively transfer respective color developer images onto a recording medium carried on a recording medium carrying member, and an image forming apparatus in which respective color developer images are successively transferred onto an intermediary transfer member and then are simultaneously transferred onto a recording medium. Similar effects can be achieved by applying the present invention to the developer supply container, detachably mountable to the above described image forming apparatuses, and the developer receiving apparatus for receiving the developer supply container.

INDUSTRIAL APPLICABILITY

As described hereinabove, according to the present invention, it is possible to provide a developer supply container capable of being easily set or mounted in a developer receiving apparatus even in the case where a constitution for determining adaptability of the developer supply container to the developer receiving apparatus is employed. Further, it is also possible to provide a developer supply system capable of easily setting or mounting a developer supply container in a developer receiving apparatus even in the case where a constitution for determining adaptability of the developer supply container to the developer receiving apparatus is provided.

The invention claimed is:

1. A developer supply container demountably settable in a developer supply apparatus provided with an adaptation portion, said developer supply container comprising:

a container body including an inner space that accommodates a developer and a discharge opening for permitting discharging of the developer;

a feeding portion that feeds the developer in said container body toward said discharge opening with rotation of said container body;

an erroneous set prevention portion provided on a peripheral surface of said container body configured and positioned to permit or prevent, after said developer supply container is partially inserted into the developer supply apparatus along a rotational axis direction of said developer supply container, a further inserting operation for setting said developer supply container into the developer supply apparatus depending on the correspondence of said erroneous set prevention portion to a configuration of the adaptation portion; and a leading portion configured to rotate said container body with the inserting operation of said developer supply container to lead said erroneous set prevention portion toward the adaptation portion irrespective of a rotational position of said erroneous set prevention portion when said developer supply container is inserted.

2. A container according to claim 1, further comprising a plurality of said leading portions provided at regular intervals along the rotational axis direction.

3. A container according to claim 2, wherein the developer supply apparatus includes a plurality of the adaptation portions, and wherein the number of the adaptation portions is an integer multiple of the number of said leading portions.

4. A container according to claim 1, wherein said leading portion limits the degree of rotation of said container body with the inserting operation of said developer supply container to be within 60 degrees.

5. A container according to claim 1, wherein said leading portion is rotatable integrally with said container body and is provided on a peripheral surface of said container body at a position downstream of said erroneous set prevention portion with respect to the inserting direction of said developer supply container, and said leading portion includes a projected portion provided with an incline relative to the rotational axis direction.

6. A container according to claim 1, further comprising a dismount leading portion configured to rotate said container body with the dismounting operation of said developer supply container so that said erroneous set prevention portion is lead toward the adaptation portion, irrespective of the rotational position of said erroneous set prevention portion at the time when said developer supply container is removed from the developer supply apparatus along the rotational axis direction.

7. A container according to claim 6, wherein said dismount leading portion is rotatable integrally with said container body, and is provided on the peripheral surface of said container body at a position downstream of said erroneous set prevention portion with respect to a dismounting direction of said developer supply container and includes a projected portion provided with a surface inclined relative to the rotational axis direction.

8. A container according to claim 7, wherein said erroneous set prevention portion is provided with a plurality of projections disposed at different positions with respect to the rotational axis direction so as to correspond to the configuration of the adaptation portion.

9. A developer supply container demountably settable in a developer supply apparatus provided with a rotatable adaptation portion, said developer supply container comprising:

a container body including an inner space that accommodates a developer and a discharge opening for permitting discharging of the developer;

a feeding portion that feeds the developer in said container body toward said discharge opening with rotation of said container body;

an erroneous set prevention portion provided on a peripheral surface of said container body configured and positioned to permit or prevent, after said developer supply container is partially inserted into the developer supply apparatus along a rotational axis direction of said developer supply container, a further inserting operation for setting said developer supply container into the developer supply apparatus depending on the correspondence of said erroneous set prevention portion to a configuration of the adaptation portion; and a leading portion configured to rotate the adaptation portion with the inserting operation of said developer supply container to lead the adaptation portion toward said erroneous set prevention portion irrespective of a rotational position of said erroneous set prevention portion when said developer supply container is inserted.

10. A container according to claim 9, further comprising a plurality of said leading portions at regular intervals along the rotational axis direction.

11. A container according to claim 9, wherein said leading portion is rotatable integrally with said container body and is provided on a peripheral surface of said container body at a position downstream of said erroneous set prevention portion with respect to the inserting direction of said developer supply container, and said leading portion includes a projected portion provided with an incline relative to the rotational axis direction.

12. A container according to claim 9, further comprising a removal leading portion configured to rotate said container body with the dismounting operation of said developer supply container so that said erroneous set prevention portion is lead toward the adaptation portion, irrespective of the rotational position of said erroneous set prevention portion at the time when said developer supply container is removed from the developer supply apparatus along the rotational axis direction.

13. A container according to claim 12, wherein said removal leading portion is rotatable integrally with said container body, and is provided on the peripheral surface of said container body at a position downstream of said erroneous set prevention portion with respect to a dismounting direction of said developer supply container and includes a projected portion provided with a surface inclined relative to the rotational axis direction.

14. A container according to claim 13, wherein said erroneous set prevention portion is provided with a plurality of projections disposed at different positions with respect to the rotational axis direction so as to correspond to the configuration of the adaptation portion.

15. A developer supply system, comprising:

a developer supply apparatus including an adaptation portion; and a developer supply container, demountably settable in said developer supply apparatus, comprising:

a container body including an inner space that accommodates a developer and a discharge opening for permitting discharging of the developer;

a feeding portion that feeds the developer in said container body toward said discharge opening with rotation of said container body;

an erroneous set prevention portion provided on a peripheral surface of said developer supply container configured and positioned to permit or prevent, after said developer supply container is partially inserted into said developer supply apparatus along a rotational axis direction of said developer supply container, a further inserting operation for setting said developer supply container into said developer supply apparatus depending on the correspondence of said erroneous set prevention portion to a configuration of said adaptation portion; and a leading portion configured to rotate said container body with the inserting operation of said developer supply container to lead said erroneous set prevention portion toward said adaptation portion irrespective of a rotational position of said erroneous set prevention portion when said developer supply container is inserted.

16. A developer supplying system comprising:

a developer supply apparatus including a rotatable adaptation portion; and a developer supply container demountably settable in said developer supply apparatus, comprising:

a container body including an inner space that accommodates a developer and a discharge opening for permitting discharging of the developer;

a feeding portion that feeds the developer in said container body toward said discharge opening with rotation of said container body;

an erroneous set prevention portion provided on a peripheral surface of said container body configured and positioned to permit or prevent, when said developer supply container is partially inserted into said developer supply apparatus along a rotational axis direction of said developer supply container, a further inserting operation for setting said developer supply container into said developer supply apparatus depending on the correspondence of said erroneous set prevention portion to a configuration of said adaptation portion; and a leading portion configured to rotate the adaptation portion with the inserting operation of said developer supply container to lead said adaptation portion toward said erroneous set prevention portion irrespective of a rotational position of said erroneous set prevention portion when said developer supply container is inserted.

17. A developer supply container demountably settable in a developer supply apparatus provided with an adaptation portion, said developer supply container comprising:

a container body including an inner space that accommodates a developer and a discharge opening for permitting discharging of the developer;

a feeding portion that feeds the developer in said container body toward said discharge opening with rotation of said container body;

an erroneous set prevention portion provided rotatably around said container body configured and positioned to permit or prevent, after said developer supply container is partially inserted into the developer supply apparatus along a rotational axis direction of said developer supply container, a further inserting operation for setting said developer supply container into the developer supply apparatus depending on the correspondence of said erroneous set prevention portion to a configuration of the adaptation portion; and a leading portion configured to rotate said erroneous set prevention portion with the inserting operation of said developer supply container to lead said erroneous set prevention portion toward the adaptation portion irrespective of a rotational position of said erroneous set prevention portion when said developer supply container is inserted.

18. A container according to claim 17, further comprising a plurality of said leading portions provided at regular intervals along the rotational axis direction.

19. A container according to claim 17, wherein said leading portion is rotatable around said container body with said erroneous set prevention portion at a position downstream of said erroneous set prevention portion with respect to an inserting direction of said developer supply container, and is provided with a projected portion provided with a surface inclined relative to the rotational axis direction.

20. A container according to claim 17, further comprising a dismount leading portion configured to rotate said erroneous set prevention portion with the dismounting operation of said developer supply container so that said erroneous set prevention portion is lead toward the adaptation portion, irrespective of the rotational position of said erroneous set prevention portion at the time when said developer supply container is removed from the developer supply apparatus along the rotational axis direction.

21. A container according to claim 20, wherein said dismount leading portion is rotatable around said container body, and is provided at a position downstream of said erroneous set prevention portion with respect to a dismounting direction of said developer supply container and includes a projected portion provided with a surface inclined relative to the rotational axis direction.

22. A container according to claim 17, wherein said erroneous set prevention portion is provided with a plurality of projections disposed at different positions with respect to the rotational axis direction so as to correspond to the configuration of the adaptation portion.

23. A developer supplying system comprising:

a developer supply apparatus including an adaptation portion; and a developer supply container demountably settable in said developer supply apparatus, said developer supply container comprising:

a container body including an inner space that accommodates a developer and a discharge opening for permitting discharging of the developer;

a feeding portion that feeds the developer in said container body toward said discharge opening with rotation of said container body;

an erroneous set prevention portion provided rotatably around said container body configured and positioned to permit or prevent, when said developer supply container is partially inserted into said developer supply apparatus along a rotational axis direction of said developer supply container, a further inserting operation for setting said developer supply container into said developer supply apparatus depending on the correspondence of said erroneous set prevention portion to a configuration of said adaptation portion; and a leading portion configured to rotate erroneous set prevention portion with the inserting operation of said developer supply container to lead said erroneous set prevention portion toward said adaptation portion irrespective of a rotational position of said erroneous set prevention portion when said developer supply container is inserted.

24. A developer supply container demountably settable in a developer supply apparatus provided with a rotatable adaptation portion, said developer supply container comprising:

a container body including an inner space that accommodates a developer and a discharge opening for permitting discharging of the developer;

a feeding portion that feeds the developer in said container body toward said discharge opening with rotation of said container body;

an erroneous set prevention portion provided rotatably around said container body configured and positioned to permit or prevent, when said developer supply container is partially inserted into the developer supply apparatus along a rotational axis direction of said developer supply container, a further inserting operation for setting said developer supply container into the developer supply apparatus depending on the correspondence of said erroneous set prevention portion to a configuration of the adaptation portion; and a leading portion configured to rotate said erroneous set prevention portion and the adaptation portion with the inserting operation of said developer supply container to lead said erroneous set prevention portion and the adaptation portion so that said erroneous set prevention portion and the adaptation portion are opposed to each other, irrespective of a rotational position of said erroneous set prevention portion when said developer supply container is inserted.

25. A container according to claim 24, further comprising a plurality of said leading portions provided at regular intervals along the rotational axis direction.

26. A container according to claim 24, wherein said leading portion is rotatable around said container body with said erroneous set prevention portion at a position downstream of said erroneous set prevention portion with respect to an inserting direction of said developer supply container, and is provided with a projected portion provided with a surface inclined relative to the rotational axis direction.

27. A container according to claim 24, further comprising a dismount leading portion capable of rotating said erroneous set prevention portion and the adaptation portion with the dismounting operation of said developer supply container so that said erroneous set prevention portion and the adaptation portion are lead to be opposed to each other, irrespective of the rotational position of said erroneous set prevention portion at the time when said developer supply container is removed from the developer supply apparatus along the rotational axis direction.

28. A container according to claim 27, wherein said dismount leading portion is rotatable around said container body, and is provided at a position downstream of said erroneous set prevention portion with respect to a dismounting direction of said developer supply container and includes a projected portion provided with a surface inclined relative to the rotational axis direction.

29. A container according to claim 24, wherein said erroneous set prevention portion is provided with a plurality of projections disposed at different positions with respect to the rotational axis direction so as to correspond to the configuration of the adaptation portion.

30. A developer supplying system comprising:

a developer supply apparatus comprising a rotatable adaptation portion; and a developer supply container demountably settable in said developer supply apparatus, said developer supply container comprising:

a container body including an inner space that accommodates a developer and a discharge opening for permitting discharging of the developer;

a feeding portion that feeds the developer in said container body toward said discharge opening with rotation of said container body;

an erroneous set prevention portion, provided rotatably around said container body configured and positioned to permit or prevent, after said developer supply container is partially inserted into said developer supply apparatus along a rotational axis direction of said developer supply container, a further inserting operation for setting said developer supply container into said developer supply apparatus depending on the correspondence of said erroneous set prevention portion to a configuration of said adaptation portion; and a leading portion configured to rotate said erroneous set prevention portion and said adaptation portion with the inserting operation of said developer supply container to lead said erroneous set prevention portion and said adaptation portion so that said erroneous set prevention portion and said adaptation portion are opposed to each to other, irrespective of a rotational position of said erroneous set prevention portion when said developer supply container is inserted.

* * * * *